US008308126B2

(12) United States Patent
Arocena Begareche et al.

(10) Patent No.: US 8,308,126 B2
(45) Date of Patent: Nov. 13, 2012

(54) PERIPHERAL SLAB FORMWORK SYSTEM

(75) Inventors: Alberto Arocena Begareche, Guipuzcoa (ES); Iñigo Kerejeta Garmendia, Guipuzcoa (ES); Miren Arantzazu Igartua Irizar, Guipuzcoa (ES); Iñaki Lizarazu Zaldua, Guipuzcoa (ES); Garikoitz Mendizabal Asurabarrena, Guipuzcoa (ES)

(73) Assignee: ULMA C Y E, S. COOP, Onate (ES)

( * ) Notice: Subject to any disclaimer, the term of this patent is extended or adjusted under 35 U.S.C. 154(b) by 1115 days.

(21) Appl. No.: 11/884,983

(22) PCT Filed: Feb. 23, 2005

(86) PCT No.: PCT/ES2005/000083

§ 371 (c)(1),
(2), (4) Date: Aug. 25, 2008

(87) PCT Pub. No.: WO2006/089975

PCT Pub. Date: Aug. 31, 2006

(65) Prior Publication Data

US 2009/0212195 A1 Aug. 27, 2009

(51) Int. Cl.
*E04G 11/36* (2006.01)

(52) U.S. Cl. ..... 249/18; 249/28; 249/192

(58) Field of Classification Search ..... 249/18, 249/24, 28, 29, 30, 31, 210; 52/126.6, 802.1; 108/64, 65, 147.12, 147.15, 156, 157.1; 182/152
See application file for complete search history.

(56) References Cited

U.S. PATENT DOCUMENTS 1,907,877 A * 5/1933 Roos ..... 249/193
3,047,931 A * 8/1962 Boettner ..... 249/18
3,130,470 A * 4/1964 Bowden et al. ..... 249/192
3,409,266 A * 11/1968 Jennings ..... 249/18
3,445,084 A * 5/1969 Williams ..... 249/192
3,533,592 A * 10/1970 Jennings ..... 249/18
3,614,048 A * 10/1971 Young ..... 249/18
3,784,151 A * 1/1974 Steele ..... 249/18
3,807,681 A * 4/1974 Kane et al. ..... 249/29
3,847,340 A * 11/1974 Ficken et al. ..... 249/18
3,915,423 A * 10/1975 Tooley ..... 249/210
3,977,536 A * 8/1976 Moore et al. ..... 414/11
4,106,256 A * 8/1978 Cody ..... 52/646
4,227,672 A * 10/1980 Cunningham ..... 249/28
4,585,204 A * 4/1986 Parker et al. ..... 249/28
4,926,593 A * 5/1990 Johnston ..... 52/126.4

(Continued)

FOREIGN PATENT DOCUMENTS

ES 8607459 1/1986

(Continued)

*Primary Examiner* — Darnell Jayne
*Assistant Examiner* — Joshua Rodden
(74) *Attorney, Agent, or Firm* — Schiff Hardin LLP

(57) ABSTRACT

The invention relates to a perimetral slab formwork system applicable for configuring a cantilever on a base grid formwork, configured by primary beams between which formwork panels are housed. In one possible solution, it incorporates perimetral beams provided with connectors for coupling on props and a straining piece which is vertically placed between outer and inner perimetral formwork panels supported by the perimetral beams to aid in lowering a formwork stripping tool connected to the outer panels. In another solution for smaller cantilevers, it has second perimetral beams having a matching configuration with the primary beams extending with regard to the base formwork combined with perimetral clamps fitting in one of their ends provided with a connector for a prop and housing for railings.

7 Claims, 25 Drawing Sheets

U.S. PATENT DOCUMENTS

| | | | | | |
|---|---|---|---|---|---|
| 5,273,415 | A | * | 12/1993 | Jackson | 425/62 |
| 5,614,122 | A | * | 3/1997 | Schworer | 249/210 |
| 5,643,487 | A | * | 7/1997 | Malone | 249/18 |
| 6,042,074 | A | * | 3/2000 | Cusimano | 248/354.1 |
| 7,530,545 | B2 | * | 5/2009 | Gillespie et al. | 249/210 |
| 7,571,888 | B2 | * | 8/2009 | Arozena Bergaretxe | 249/18 |
| 7,640,871 | B2 | * | 1/2010 | Arozena Bergaretxe | 108/150 |
| 2004/0075042 | A1 | * | 4/2004 | Arozena Bergaretxe | 249/210 |
| 2006/0027727 | A1 | * | 2/2006 | Gillespie et al. | 249/18 |

FOREIGN PATENT DOCUMENTS

| | | | | |
|---|---|---|---|---|
| ES | 2017322 | | | 1/1991 |
| ES | 2208064 | | | 6/2004 |
| ES | 2222842 | | | 2/2005 |
| GB | 2029483 | A | * | 3/1980 |
| GB | 2107776 | A | * | 5/1983 |
| GB | 2127474 | | | 4/1984 |
| NL | 1005165 | | | 8/1998 |
| WO | 02/084050 | | | 10/2002 |

* cited by examiner

PERIPHERAL SLAB FORMWORK SYSTEM

BACKGROUND

The present invention relates to a perimetral slab formwork system that can especially be applied for those slabs requiring an additional working surface that allows arranging formwork risers and the movement of people.

To build concrete floor slabs, a complete formwork floor is made using a series of elements supporting panels the arrangement of which provides a smooth and horizontal surface on which the concrete is poured to obtain the floor slab once it has set.

Grid formwork structures are known, which are generally formed by a series of longitudinal beams combined with cross beams housing the formwork panels in a fixed position, said beams being supported by props.

An example of this type of structure is described in International Patent Application PCT/ES01/00133, belonging to the applicant of the present invention, which contemplates the incorporation of support bolsters located in the props on which the primary beams and the cross beams closing the grid are assembled, the cross beams being fixed by nailing their ends into the bolsters, providing an exact measurement between primary beams and stiffening the structure before arranging the formwork panels, which are then assembled in the area thus defined quickly and easily. The assembly rate is thus increased, and the number of operators required for the job is therefore reduced.

In the event of increasing the overhang of the formwork and/or aiding in personnel safety, some solutions are known which conventionally use supplementary wedges and braces, and the beams can also be extended in length to form a service scaffold support.

SUMMARY

An object of the invention is a formwork system which quickly and safely aids in erecting and stripping formwork from a perimetral working surface via the aid of a group of elements with a particular configuration forming the formwork structure combined with the fixing mechanism assuring the stability of the structure and aiding in assembly and disassembly work.

Another object of the invention is the participation of a formwork stripping mechanism aiding in the disassembly of the outermost formwork panels of the perimetral formwork.

The perimetral slab formwork system that is the object of this invention allows quickly, easily and safely assembling and disassembling of an additional perimetral surface on a grid-type slab formwork, which shall be referred to hereinafter as base formwork, which is formed by structure comprising primary beams supported by vertical props having bolsters which said primary beams are fit in.

The perimetral formwork system proposed according to various embodiments of the invention includes perimetral beams facilitating the perimetral slab formwork and allowing the placement of formwork panels. The perimetral beams extend with regard to the base formwork, either in the same direction as the primary beams of the base formwork assembled on the bolsters or in the direction that is perpendicular to the primary beams of the base formwork with the collaboration of joining clamps.

Two possible solutions for assembling the perimetral formwork are distinguished: a perimetral solution with first perimetral beams and a straining piece used for the case of taking out the overhang of the formwork a considerable distance, in which the straining piece collaborates in stripping the formwork with a formwork stripping tool removing the last panels, and a solution with a perimetral clamp for small overhangs, in which the clamp is an end auxiliary part aiding in the assembly of second perimetral beams.

The first perimetral beam has a moving connector for coupling a prop and bringing it closer to the end of the slab, an inclined connector for an inclined prop aiding in the assembly of the perimetral formwork and a housing for the assembly of the railing shoe.

If the first perimetral beam is assembled in the direction of the primary beam of the base formwork, it is supported on the bolster of the last row with formwork on it, it will have an additional support which, placed in the moving connector, will be located close to the end of the slab, and two possible solutions are provided to prevent overturning when working in the overhang area:

Incorporating an inclined prop in the inclined connector and including the fixing element in the joint between the first perimetral beam and bolster.

Incorporating a mooring for fixing the end of the first perimetral beam to the slab with straps and the latter to the slab with a mooring anchored to the slab.

If the first perimetral beam is assembled at 90° with regard to the primary beams defining the cantilever in the perpendicular direction, the perimetral beam is connected to the primary beams of the last row with formwork on it via a joining clamp, making it necessary to place an additional prop to support the cross beam, and in addition its overturning should be prevented when working in the overhang area via one of the following possibilities:

Incorporating an inclined prop coupled to the inclined connector and including the joining clamp between the two beams which has the connector for the additional prop.

Incorporating a mooring for fixing the end of the first perimetral beam to the slab with straps and the latter to the slab with a mooring anchored to the slab. This mooring also has the connector for the additional prop.

The aforementioned fixing element comprises a fastening bolt mooring an end coupling of the perimetral beam to the bolster, preventing the overturning thereof and essentially comprising a usually bent, cylindrical, elongated body introduced on one hand into a cavity in the perimetral beam and on the other trapped between the bolster and the base of the perimetral beam.

The previously described mooring comprises a plate provided with a fixing mechanism for fixing it to the perimetral beam or to the slab and has a hole in which the corresponding strap can be placed for forming the tension between the slab and the perimetral beam. A connector intended for coupling of a prop extends at the lower part from the plate.

The aforementioned joining clamp is a safety element forming the joint between the perimetral beam and the primary beam and preventing the overturning of the perimetral beam. The joining clamp has a guide for fitting the perimetral beam and a guide for fitting the primary beam formed by a fold and a dentation of a moving part which moves until fixing its position with regard to the primary beam by a fixing mechanism such as a wedge. The joining clamp is also provided with a connector to aid in the coupling of a prop.

In addition, the straining piece, which is another essential element of the system, is used in the perimetral slab formwork together with the first perimetral beam, is placed vertically, usually arranged in the middle towards the overhang between the innermost panels and the outermost panels, it is a material bearing a section of the perimetral slab and aids when stripping the recoverable material of the formwork by temporarily supporting the first perimetral beams. It also has an upper support resting on first perimetral beams and has lower connectors for their connection to the props.

The aforementioned formwork stripping tool is used for stripping the outermost panels of the formwork that can not be removed by sliding inwardly due to the fact that they collide with the straining piece, and it comprises a tubular structure linking at one end in a hole in a central web of the straining piece, grips the formwork panels via respective side support tongues and lowers them towards the inside of the perimetral formwork. Access to the outermost panels is thus aided by making it simpler to disassemble then.

The straining piece is therefore the fixed part having side stops that the first perimetral beams of the formwork panels are supported against in the formwork stripping situation. Once these first perimetral beams are removed, the formwork stripping tool is lowered with regard to the straining piece, aiding the disassembly of the outermost panels.

In addition the solution using a perimetral clamp is highly useful when the distance that the base formwork must project is small. As in the case of an assembly with a straining piece, it is contemplated that the second perimetral beams can be assembled in two possible directions with regard to the base formwork, the direction that is longitudinal to the primary beams or in the direction that is perpendicular to said primary beams, incorporating the same fixing mechanism for fixing it to the base formwork as those described above for the solution of an assembly with a straining piece.

It should be mentioned that the second perimetral beams have the same geometry as the primary beams of the base formwork and lack the connectors provided for the first perimetral beams.

The perimetral clamp essentially comprises an L-shaped body provided with a fixing mechanism for the end of the second perimetral beam and for auxiliary elements such as the railing, and incorporates a connector for housing a railing shoe and another connector for placing the inclined prop.

The solution with a perimetral clamp is an alternative solution to the solution with a straining piece, and it has the advantages of using a lighter, less bulky, more manageable part which requires a simpler and more intuitive assembly without a straining piece and with fewer props, and it is less expensive and more versatile.

DESCRIPTION OF THE DRAWINGS

To complement the description being made and for the purpose of aiding to better understand the features the invention, according to various preferred practical embodiments thereof, a set of drawings is attached as an integral part of said description which, with an illustrative and non-limiting character, illustrate aspects of the invention as implemented in various embodiments.

DETAILED DESCRIPTION OF THE PREFERRED EMBODIMENTS

Two embodiments of the perimetral slab formwork system are described below in reference to the figures.

Figure 1D:
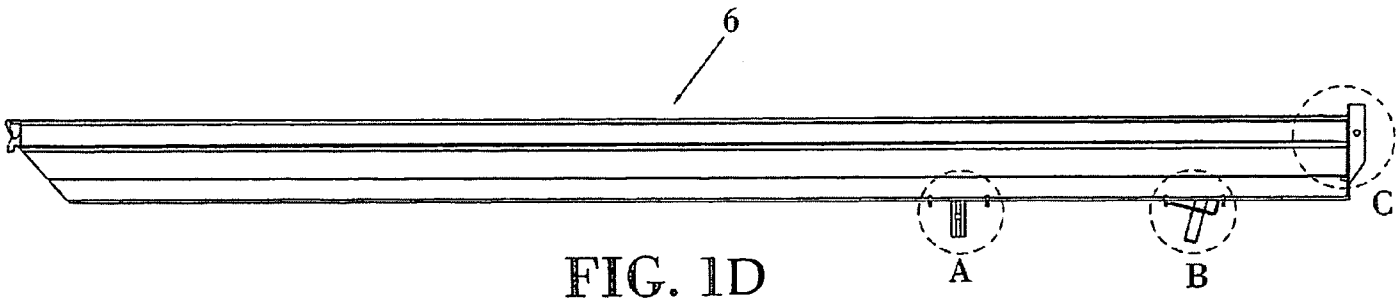
FIGS. 1A-D are an elevational view of a first perimetral beam and its connectors depicted in detail.
Figure 1C:
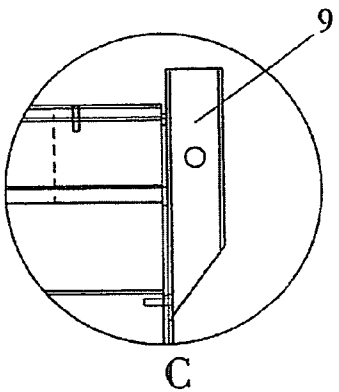
Figure 1B:
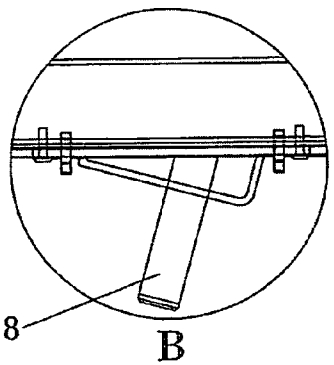
Figure 1A:
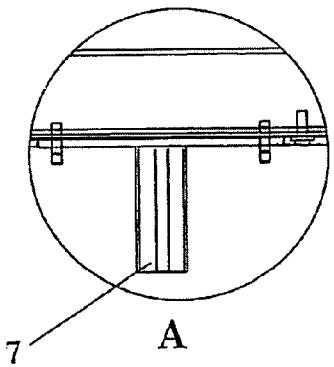
Figure 2:
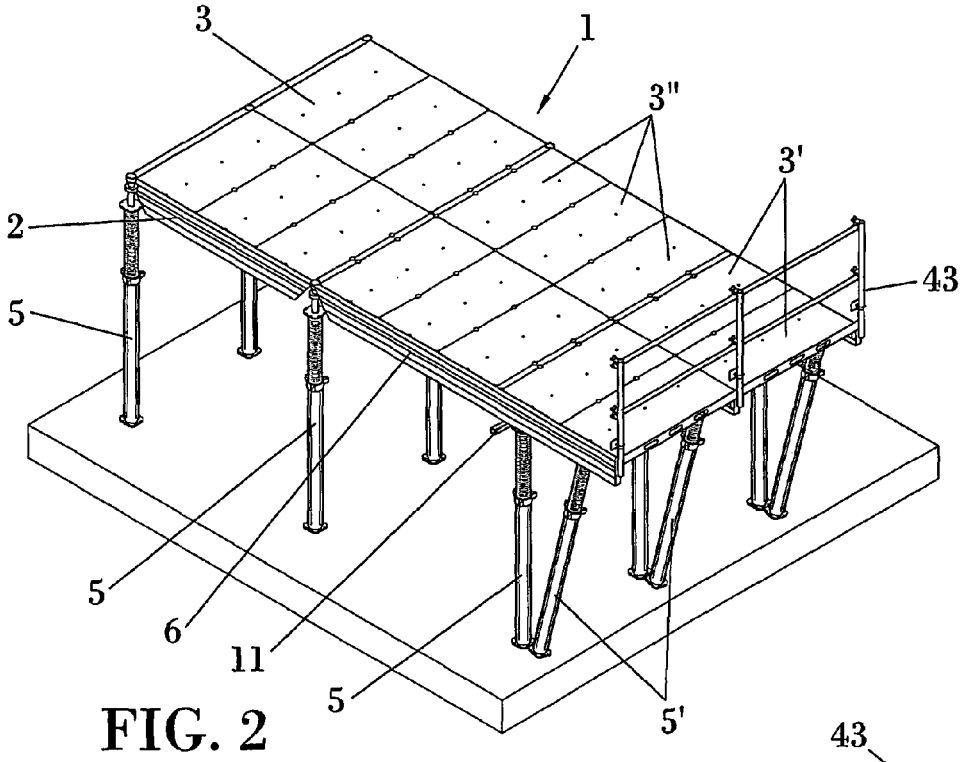
FIG. 2 is a perspective view of the perimetral formwork system for the assembly solution with a straining piece and in the direction of the primary beam of the base formwork.
Figure 4:
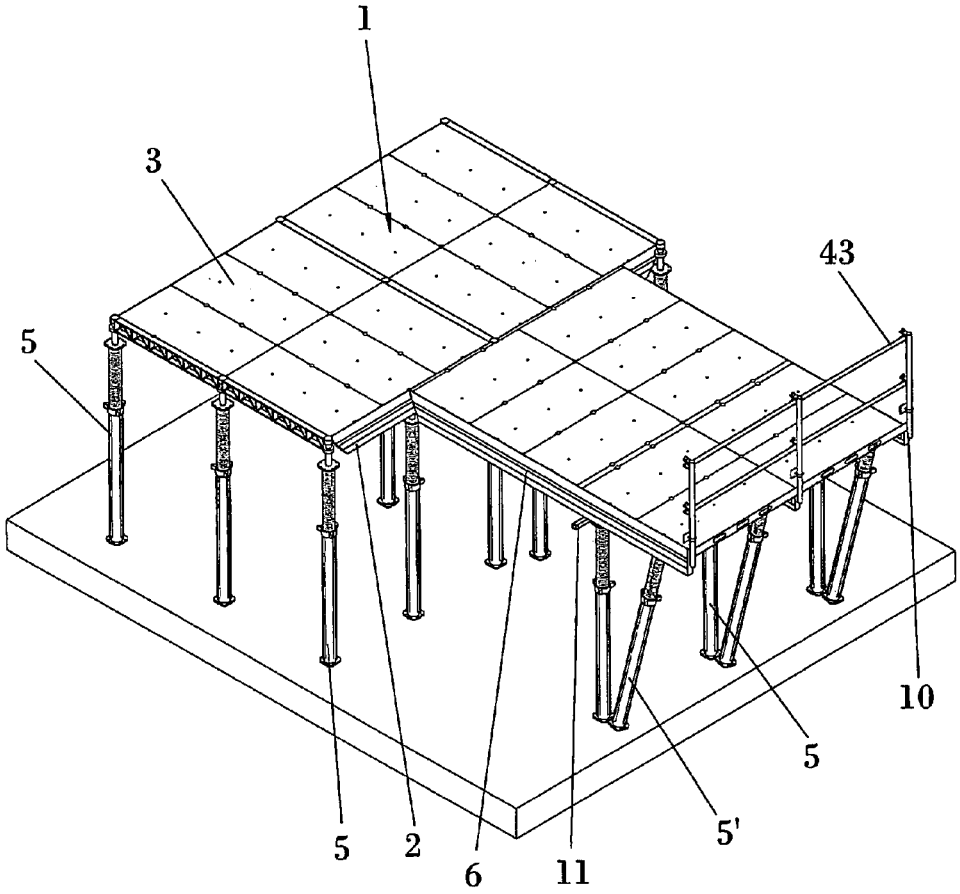
FIG. 4 is a perspective view of the perimetral formwork system for the assembly solution with a straining piece in the direction that is perpendicular to the primary beams of the base formwork.
Figure 9:
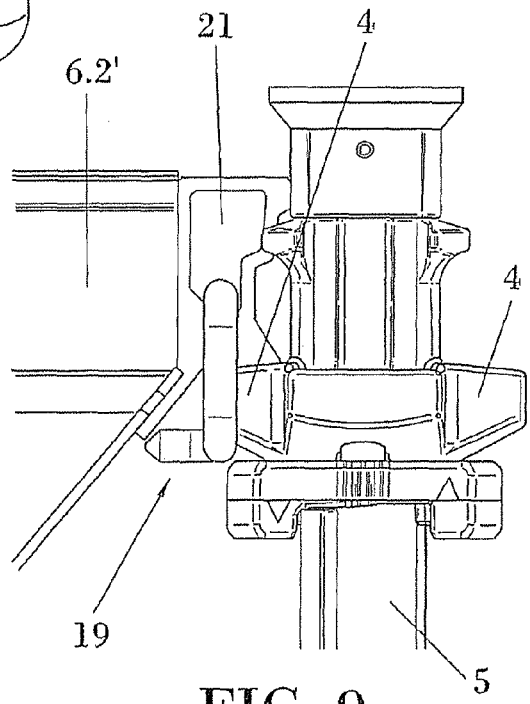
FIG. 9 is an elevational view in which the assembly of the fixing element securing the joint between the bolster of the prop and the perimetral beam is seen.

This perimetral formwork system can be applied to configure an overhang formwork in a base grid formwork 1, as shown in FIGS. 2 and 4, configured by a series of primary beams 2 between which formwork panels 3 are housed, said primary beams 2 preferably being coupled between support bolsters 4, shown in FIG. 9, integral with vertical props 5 supporting the base formwork 1.

The proposed perimetral formwork system incorporates perimetral beams 6, 2' having supports for supporting perimetral formwork panels 3', 3" and extending from the base formwork 1, either in the direction that is longitudinal to the primary beam 2, or in the direction that is perpendicular to the primary beam 2.

A first embodiment of the perimetral slab formwork system is distinguished in which first perimetral beams 6 are arranged which are provided at the lower part, as seen in FIG. 1A-1D, with: a moving connector 7 for coupling a prop 5 which can move to the selected position, an inclined connector 8 for coupling an inclined prop 5' and an end housing 9 for coupling a railing shoe 10.

Figure 3:
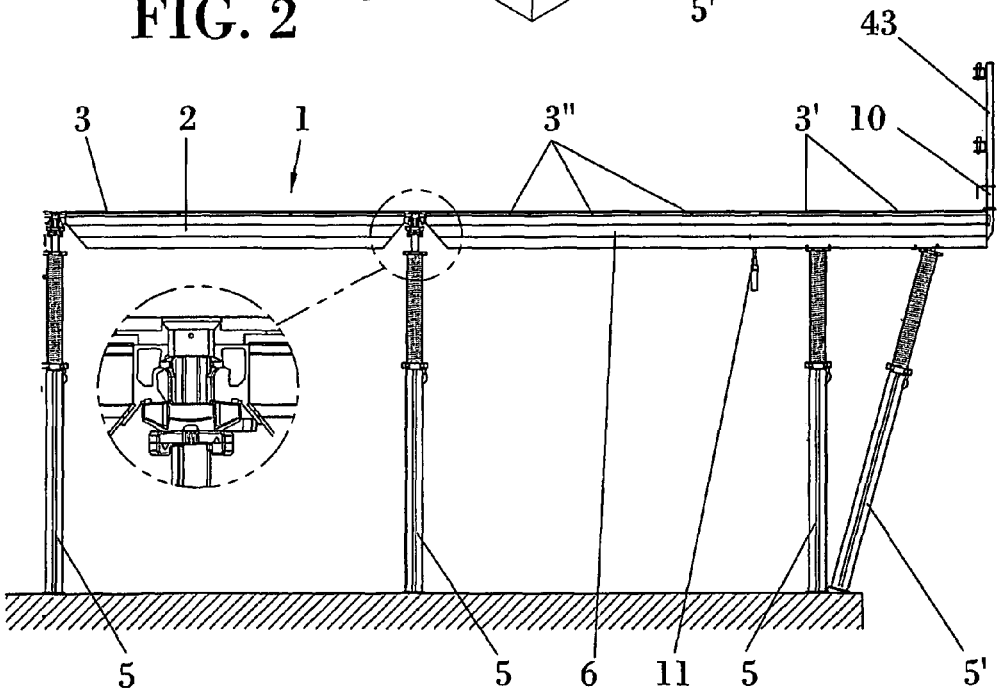
FIG. 3 is an elevational view of the solution depicted in FIG. 2.
Figure 5:
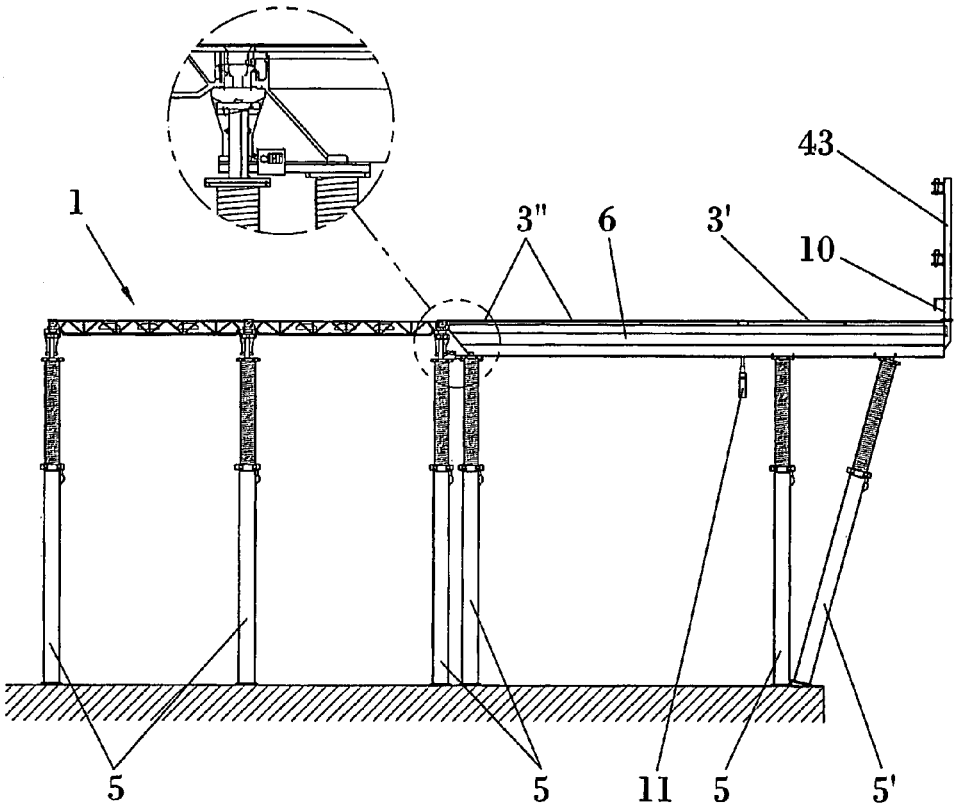
FIG. 5 is an elevational view of the solution depicted in FIG. 4.

It can be seen for this first embodiment that the first primary beams 6 can extend from the base formwork 1 in a direction that is longitudinal to the primary beams 2, as seen in FIGS. 2 and 3, or in the direction that is perpendicular to the primary beams 2, as depicted in FIGS. 4 and 5.

Figure 11:
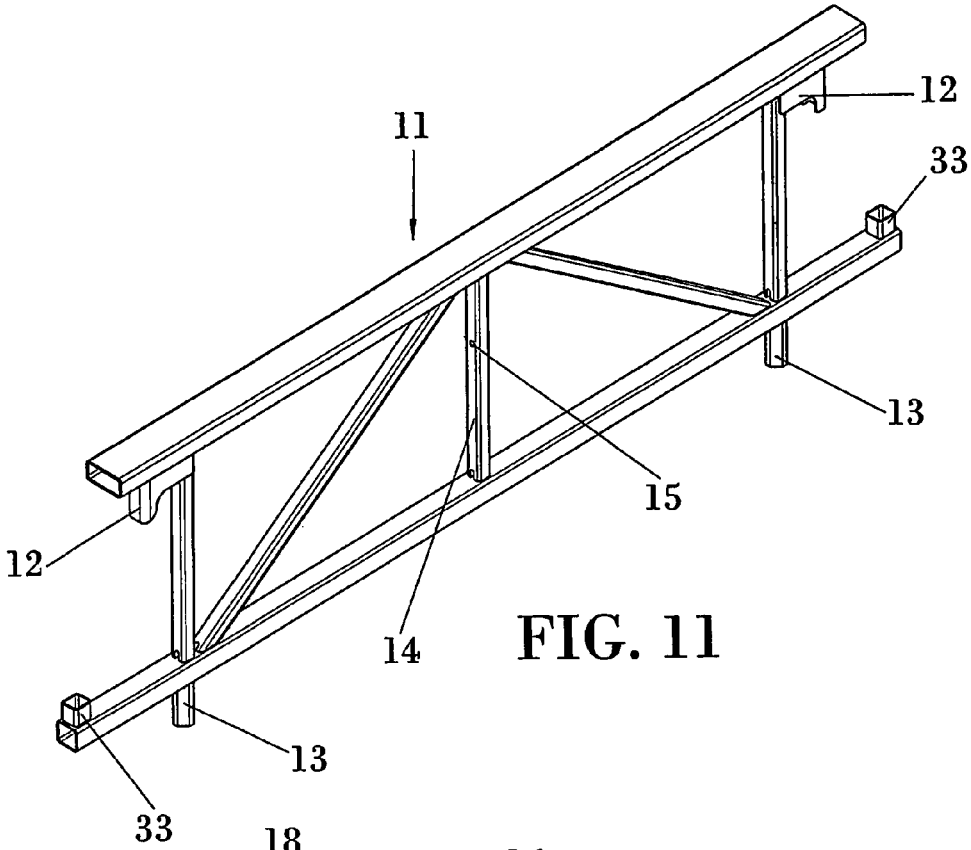
FIG. 11 is a perspective view of the straining piece.
Figure 12:
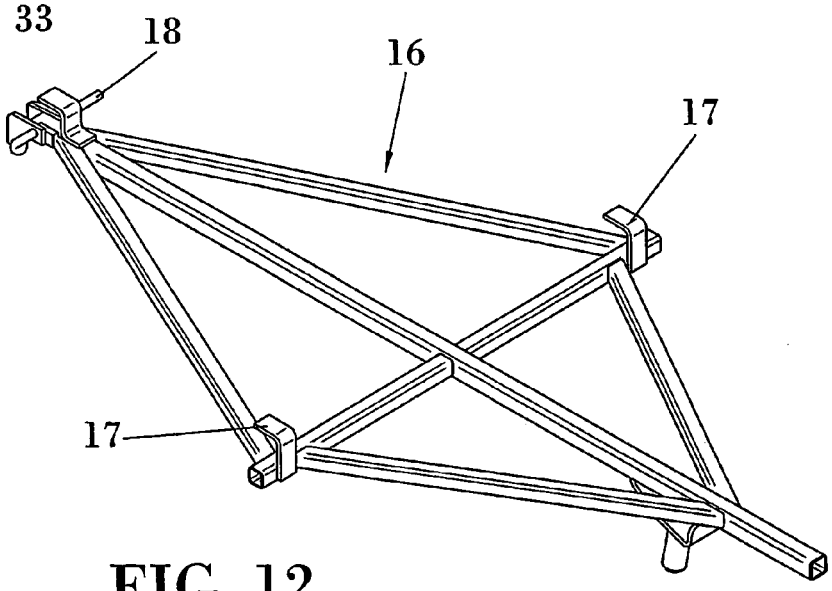
FIG. 12 is a perspective view of the formwork stripping tool.
Figure 13:
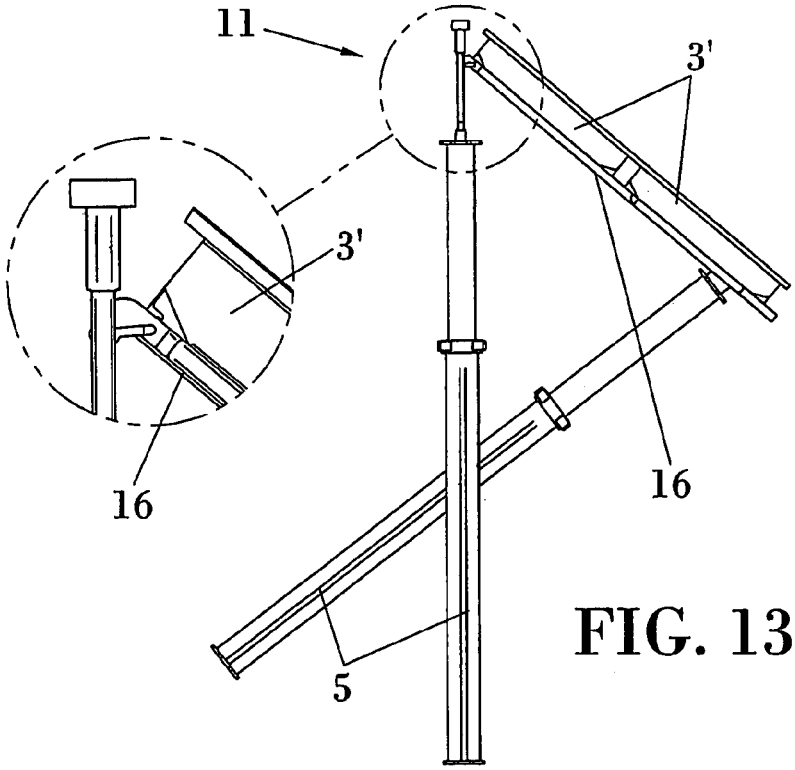
FIG. 13 is an elevational view of the formwork stripping step in which the formwork stripping tool is seen being lowered with regard to the straining piece, showing a detail of its linkage.
Figure 14:
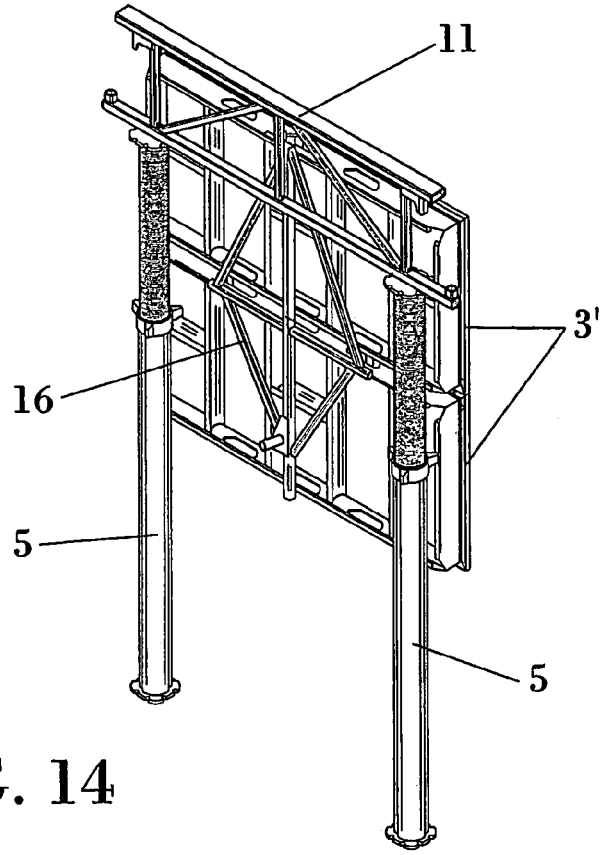
FIG. 14 is a perspective view of the formwork stripping tool lowered against the straining piece.
Figure 15:
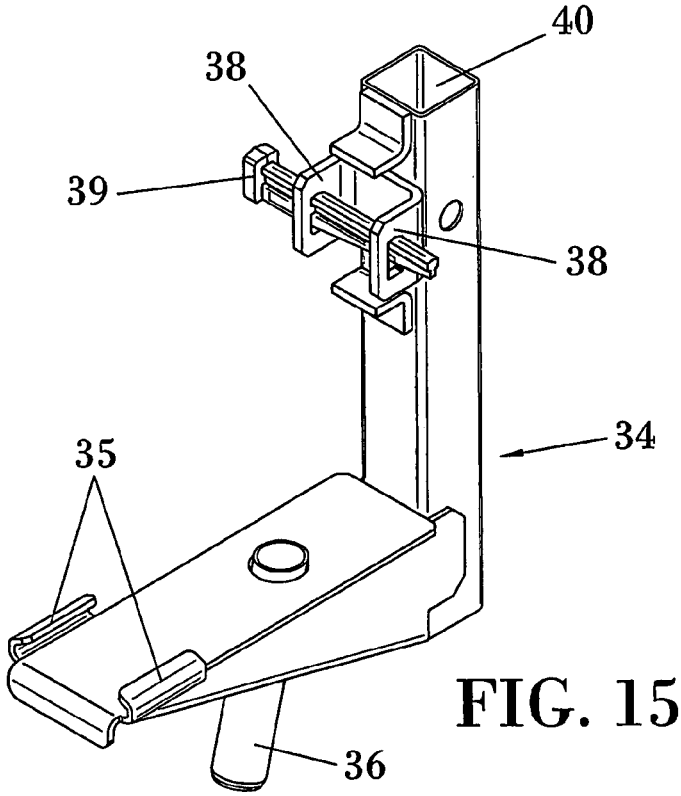
FIG. 15 is a perspective view of the perimetral clamp.
Figure 16:
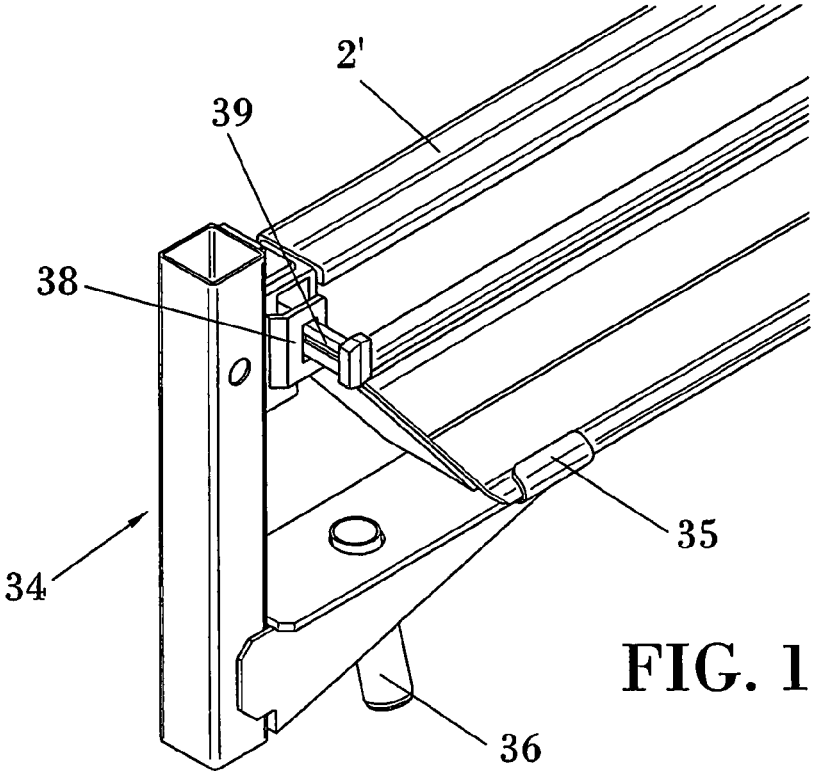
FIG. 16 is a perspective view of the joint of the perimetral clamp to the second perimetral beam.
Figure 17:
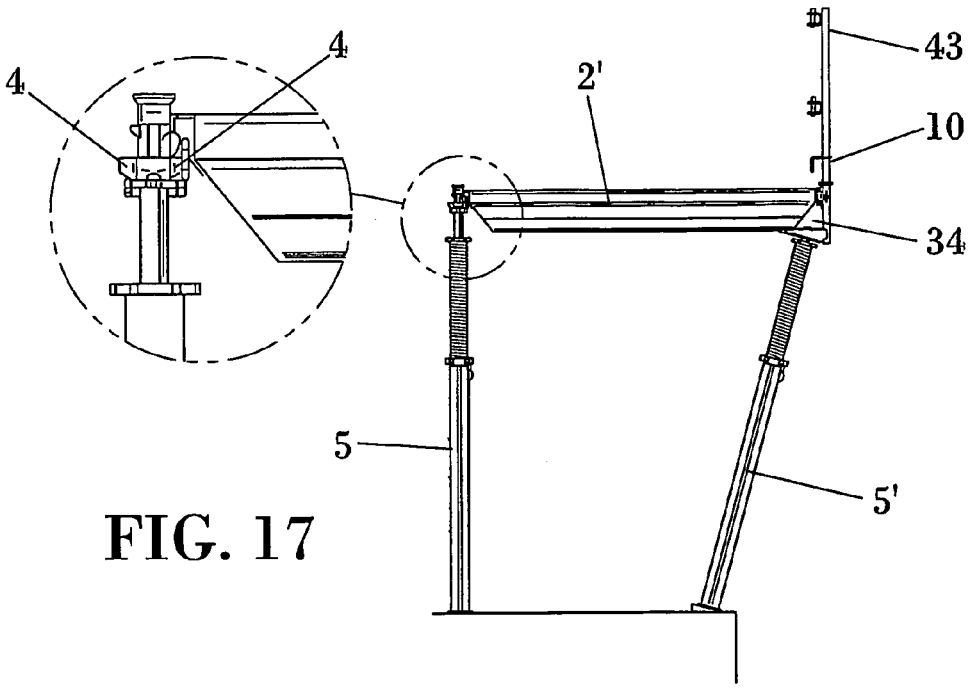
FIG. 17 is a view of the assembly solution with the perimetral clamp in the case of joining the second perimetral beam to the bolster, showing a detail thereof.
Figure 18:
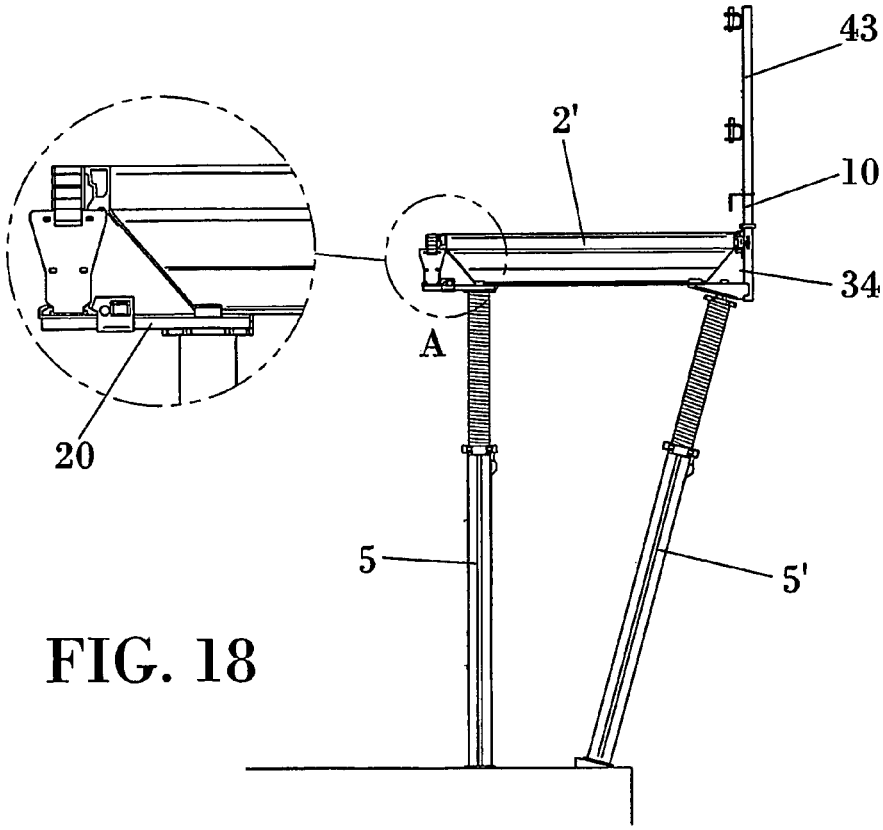
FIG. 18 is a view of the assembly solution via a perimetral clamp in which the joint of the second perimetral beam is carried out with regard to the primary beam with the collaboration of a joining clamp.

Besides the first primary beams 6, the perimetral formwork system comprises for this first embodiment the following elements:

- a fixing mechanism 19, 20, 30 for fixing the first perimetral beam 6 to the base formwork 1,
- a straining piece 11 depicted in FIG. 11, which is placed vertically between the outer 3' and inner 3" perimetral formwork panels, comprises a structure formed by an upper and lower profile beam connected by intermediate profile beams , the upper profile beam of which is provided with upper end supports 12 fitting between the first perimetral beams 6, and lower connectors 13 set out from the lower profile beam for their coupling in props 5, and it comprises an intermediate profile beam comprising a central web 14 provided with a linkage hole 15,
- a formwork stripping tool 16 shown in FIG. 12, having support tongues 17 which the outer perimetral formwork panels 3' fit in and a linkage 18 coupling in the linkage hole 15 of the straining piece 11 with regard to the one the formwork stripping tool 16 links to for aiding in lowering the outer perimetral formwork panels 3'.

A second possible embodiment of the perimetral slab formwork system contemplates incorporating second perimetral beams 2' having the same geometry as the primary beams 2, and extending with regard to the base formwork 1 combined with perimetral clamps 34, as seen in FIGS. 15 to 18. The perimetral clamps 34 show an L-shaped configuration at the base of which there are guides 35 which one of the ends of the second perimetral beam 2' fits in and on its lower side it has an inclined connector 36 coupling on an inclined prop 5', and it has in its vertical arm joining mechanism 38, 39 assuring the joining of the second perimetral beam 2' to the perimetral clamp 34, a housing 40 receiving the railing shoe 10 being provided in said vertical arm.

The joining mechanism 38, 39 can comprise perforated tabs 38 integral with the vertical arm which are traversed by a wedge 39 which likewise traverses a hole 21 in the second perimetral beam 2'.

It must be mentioned that the fixing mechanism 19, 20, 30 for fixing the second perimetral beam 2' to the base formwork 1 match up with the fixing mechanism 19, 20, 30 described for the connection between the first perimetral beam 6 described in the first embodiment with the base formwork 1.

Figure 8:
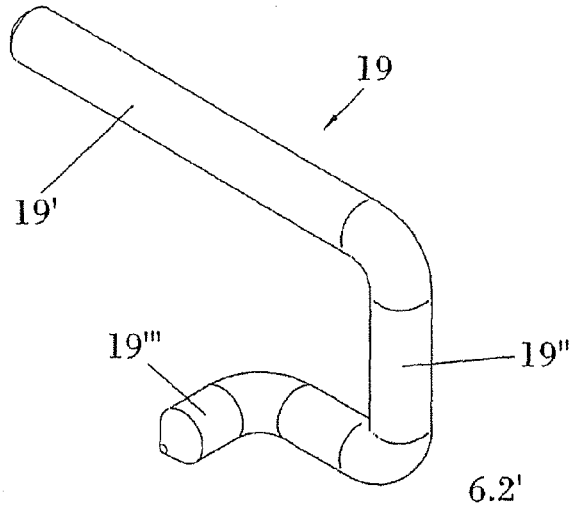
FIG. 8 is a perspective view of the fixing element.

It has been provided that for the solution in which the perimetral beam 6, 2' is located in the direction that is longitudinal to the primary beam 2, the perimetral beam 6, 2' is arranged in support bolsters 4 and the fixing mechanism 19, 20, 30 comprising a fixing element 19 depicted in FIGS. 8 and 9 which prevents the overturning of the perimetral beam 6, 2'.

The fixing element 19 is bent twice in the same vertical plane and bent once in a lower horizontal plane, establishing an upper elongated section 19' introduced in a hole 21 in the perimetral beam 6, 2', a vertical middle section 19" and a lower section 19'" introduced between the support bolster 4 and the perimetral beam 6, 2'.

Figure 6:
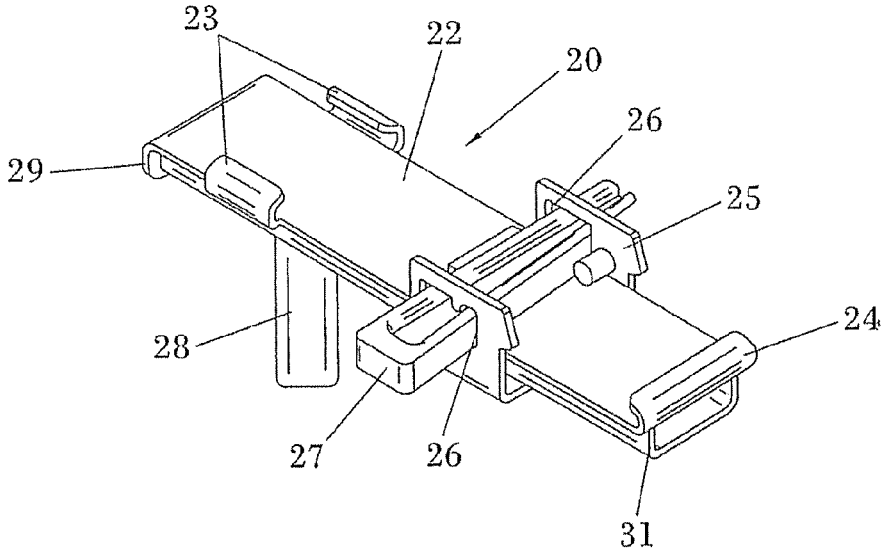
FIG. 6 is a perspective view of the joining clamp.
Figure 7A:
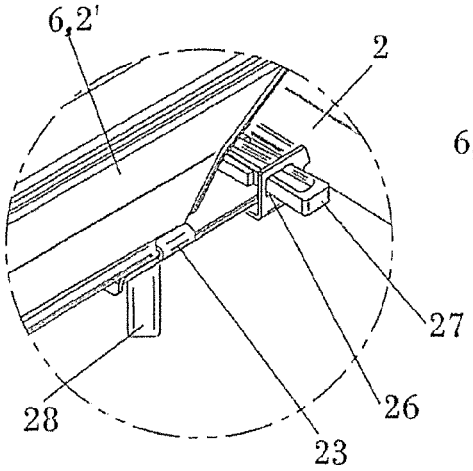
FIGS. 7A-B are respective perspective views from two different angles of the assembly at 90° of the perimetral beam and the primary beams via the joining clamp.
Figure 7B:
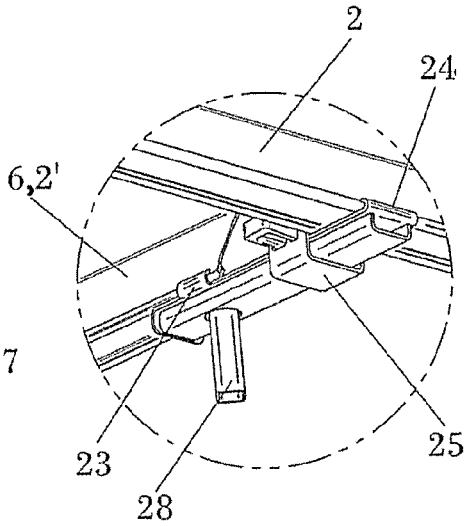

In addition, in the solution in which the perimetral beam 6, 2' extends perpendicular with regard to the primary beam 2, the fixing mechanism 19, 20, 30 comprises a joining clamp 20 depicted in FIGS. 6, 7A and 7B formed by a base reinforcement 31 on which a plate 22 is located provided with a first end fold 24 which, together with a dentation of a moving part 25, form a guide which the primary beam 2 fits in, and it is also provided with two opposing side folds 23 forming a guide which the perimetral beam 6, 2' fits in perpendicular to the primary beam 2.

The moving part 25 preferably comprises a U-shaped part movable on the plate 22, the flaps of which are provided with corresponding opposing perforations 26 traversed by a wedge 27 fixing the moving part 25 against the primary beam 2, forming the fixing thereon.

The joining clamp 20 is provided at the base of the plate 22 with a connector 28 to aid in coupling a prop 5. It can also be seen that the plate 22 has a second end fold 29, opposite to the first end fold 24, forming the striking area to aid in disassembling the joining clamp 20.

Figure 10:
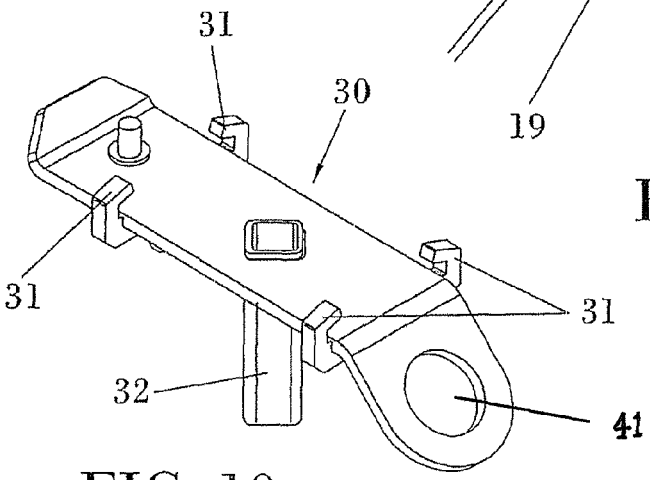
FIG. 10 is a perspective view of the mooring.

In addition the fixing mechanism 19, 20, 30 can also comprise a mooring 30, depicted in FIG. 10, formed by a plate provided with guides 31 which the end of the perimetral beam 6, 2' fits in and having a hole 41 in which a strap is tied connecting it to the slab, having under the plate a connector 32 intended for coupling a prop 5.

In relation to the straining piece 11 depicted in FIG. 11, it must be mentioned that stops 33 are located at the ends of the lower profile beam limiting the mobility of the perimetral beams 6, 2' associated to the outer perimetral formwork panels 3' when they move downwards 16 in the formwork stripping operation.

Two assembly solutions, whether the underside or top side assembly solution, are distinguished for the first embodiment of the perimetral formwork system with a straining piece 11 in which the first perimetral beam 6 is supported between support bolsters 4 oriented in a direction that is longitudinal to the primary beam 2.

Figure 19A:
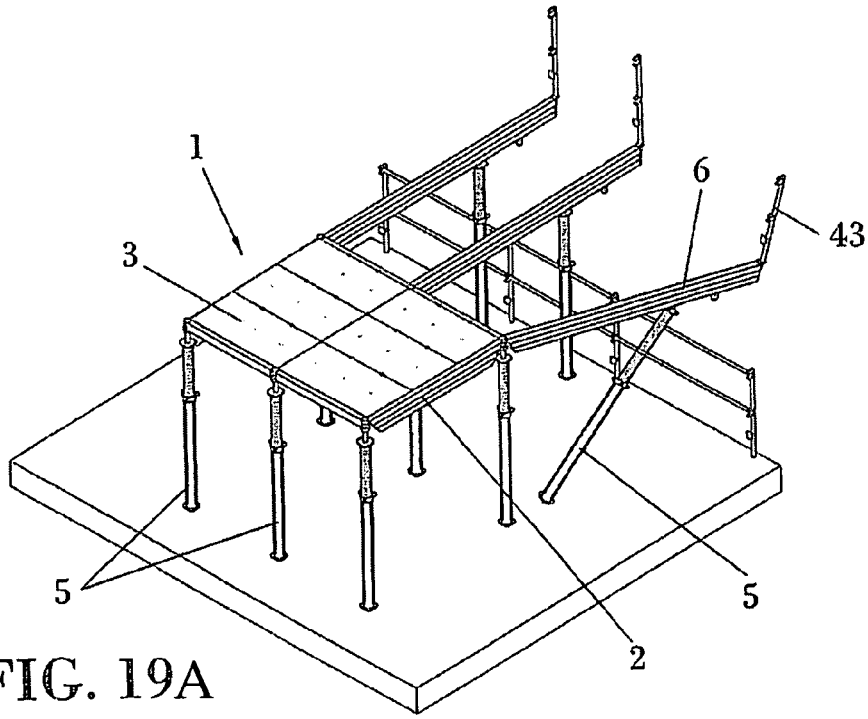
FIGS. 19A-D are views showing the underside assembly sequence of the perimetral formwork solution with the straining piece corresponding to the case that the first perimetral beam is assembled collinear to the primary beam of the base formwork.
Figure 19B:
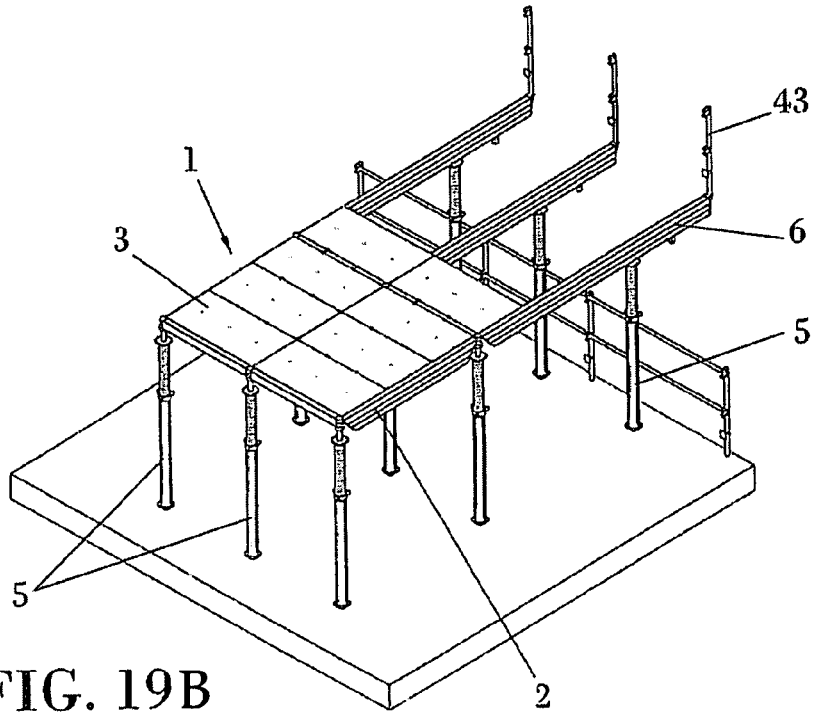
Figure 19C:
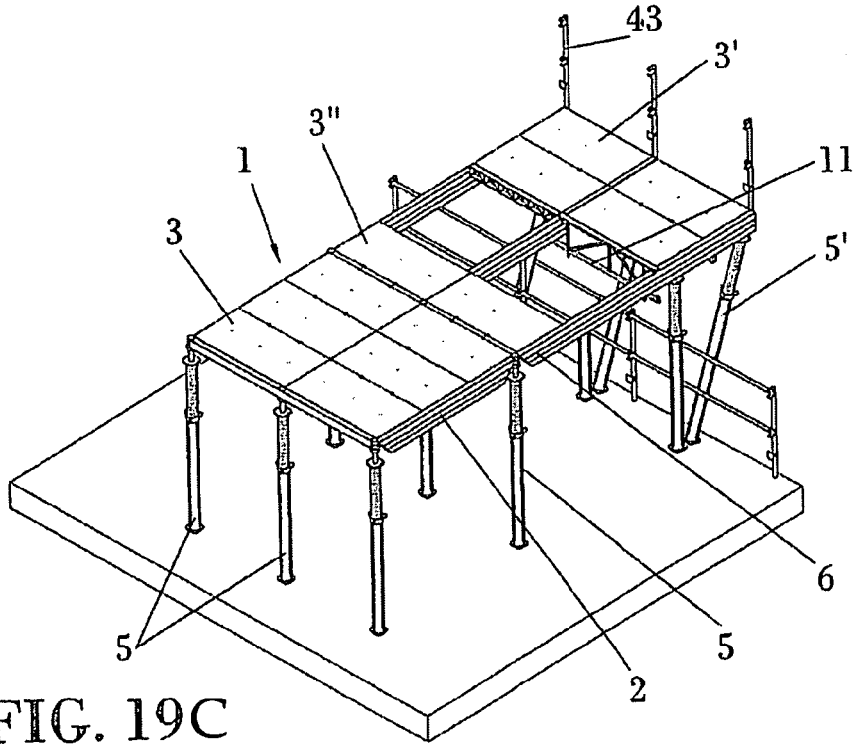
Figure 19D:
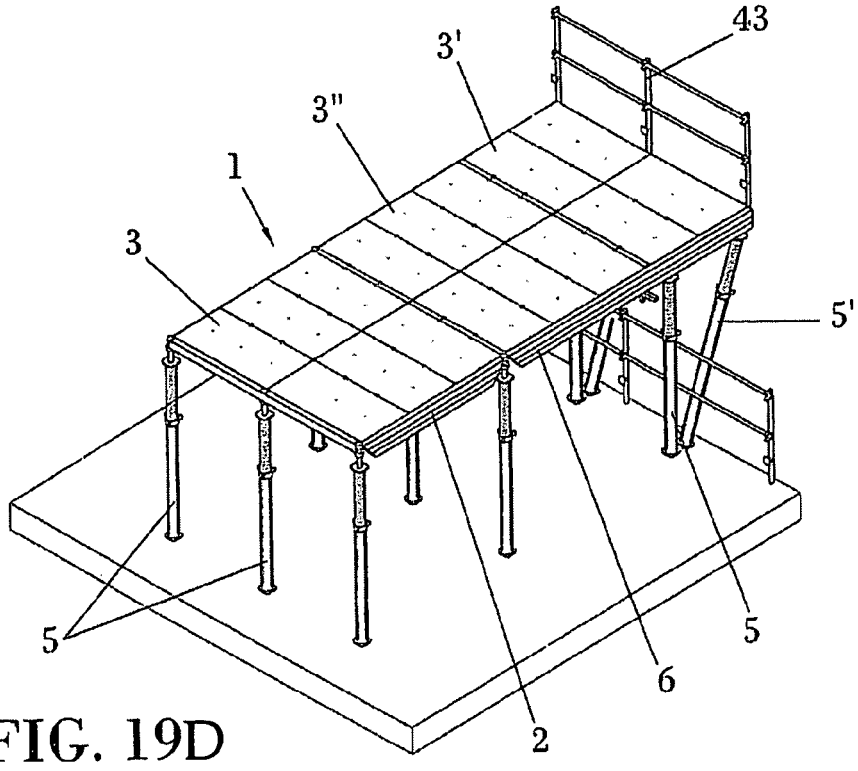

The top side assembly is depicted in FIGS. 19A to 19D and takes place according to the following steps:

First the railing shoes 10 are assembled on the housings 9 in the first perimetral beams 6, then the end of the first perimetral beam 6 is coupled in the bolster 4 and the first perimetral beam 6 is lifted via the prop 5 which moves to the area near the end of the slab—see FIG. 19B. Then the inclined prop 5' is placed according to FIG. 19B and the first perimetral beam 6 is secured to the bolster 4 via the fixing element 19, then placing the outer formwork panels 3', immediately proceeding to the assembly of the straining piece 11. Finally the inner panels 3" are installed and the process ends with the assembly of the railings 43.

Figure 20A:
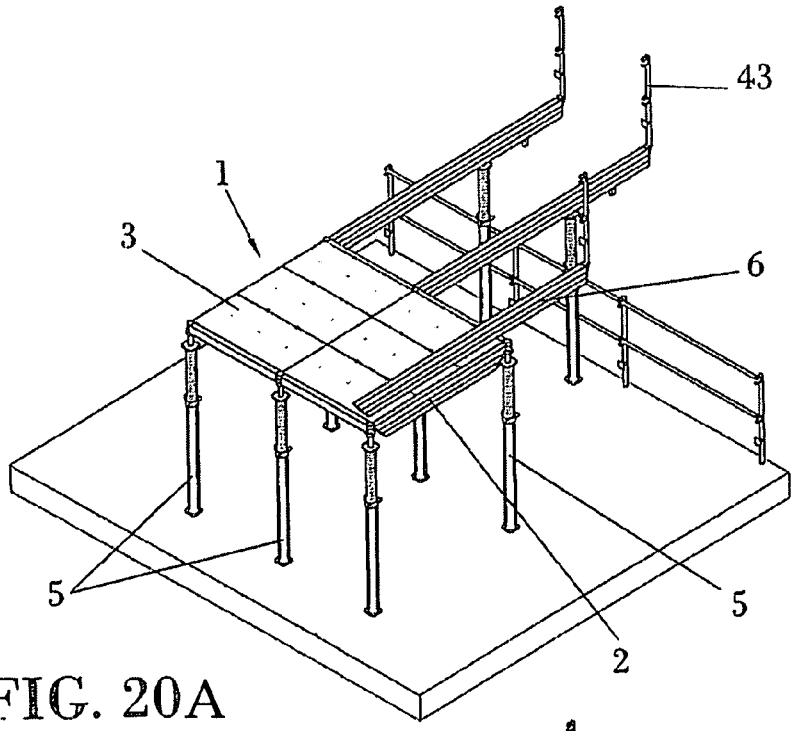
FIGS. 20A-E are views showing the top side assembly sequence of the perimetral formwork solution with the straining piece for the case that the first perimetral beam is assembled collinear to the primary beam of the base formwork.
Figure 20B:
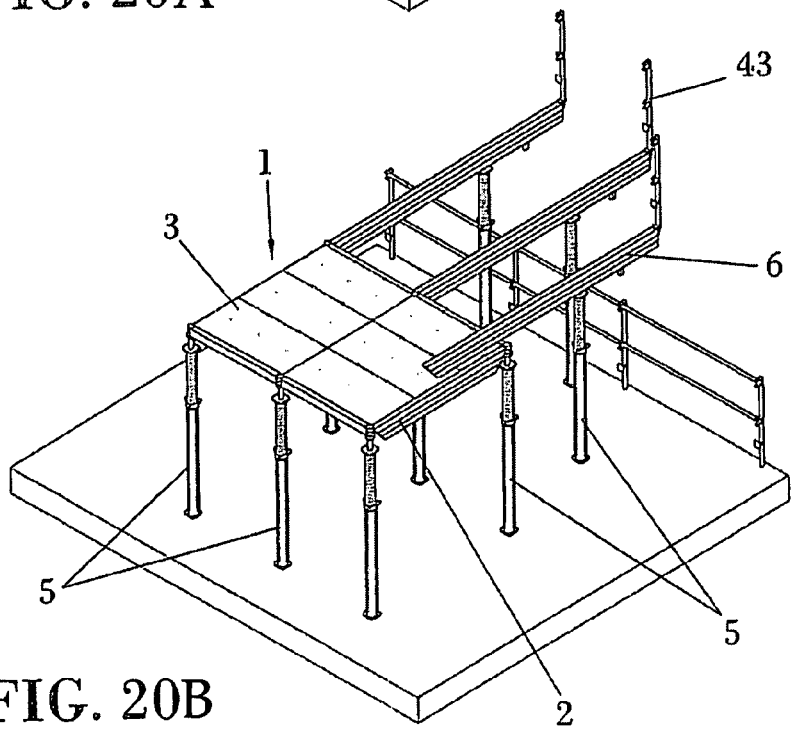
Figure 20C:
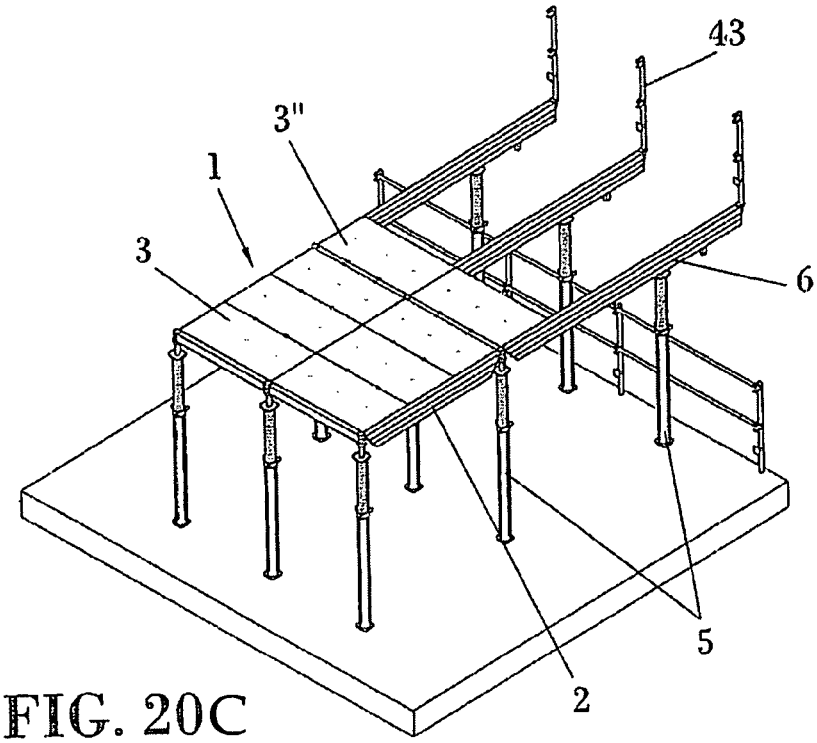
Figure 20D:
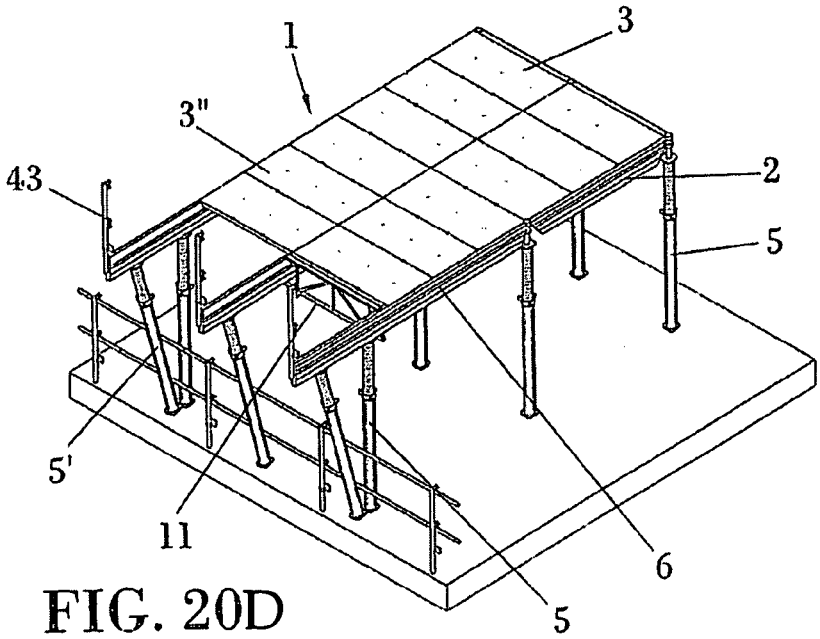
Figure 20E:
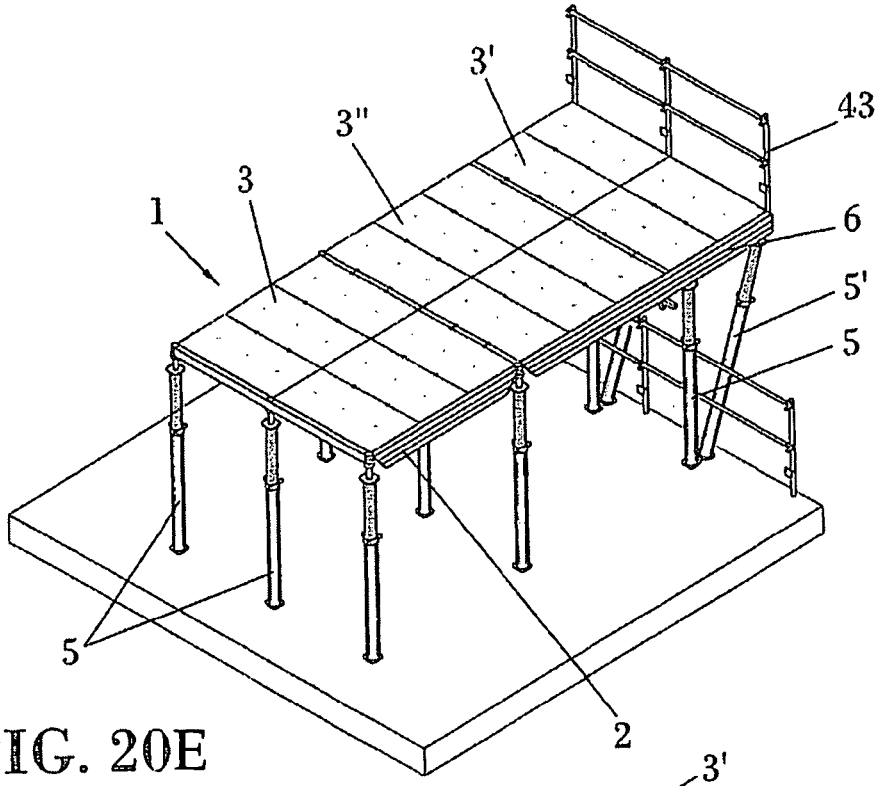

The top side assembly is depicted in FIGS. 20A to 20E and is carried out according to the steps following:

First the railing shoe 10 is placed in the first perimetral beam 6, the first perimetral beam 6 is slid over the base formwork 1 until it projects to introduce a prop 5 below it, dragging the first perimetral beam 6 until engaging it in the bolster 4, then the joining is secured by placing the fastening bolt 19. Then the inner formwork panels 3" are placed according to FIG. 20C so that the assembly becomes more increasingly stable, the system is leveled, the inclined prop 5' is placed and more inner formwork panels 3" are placed as seen in FIG. 20D in order to continue with the installation of the straining piece 11. Then the outer panels 3' are placed, ending with the assembly of the railings 43 and baseboards.

Two underside and top side assembly solutions are distinguished for the embodiment of the perimetral formwork system with a straining piece 11 in which the first perimetral beam 6 extends perpendicular with regard to the primary beams 2.

Figure 22A:
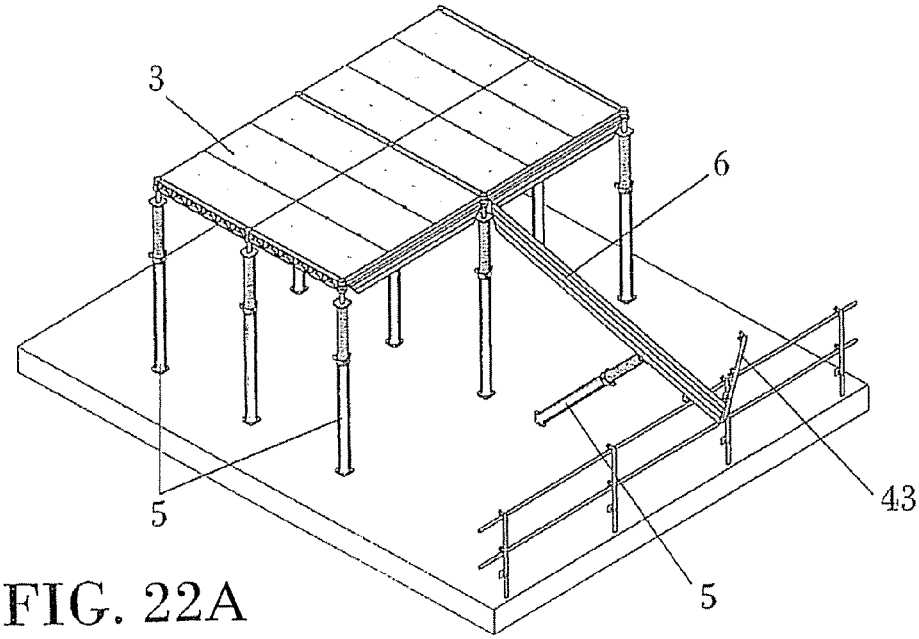
FIGS. 22A-F are views showing the underside assembly sequence of the perimetral formwork solution with the straining piece for the case of the first perimetral beam perpendicular to the primary beam.
Figure 22B:
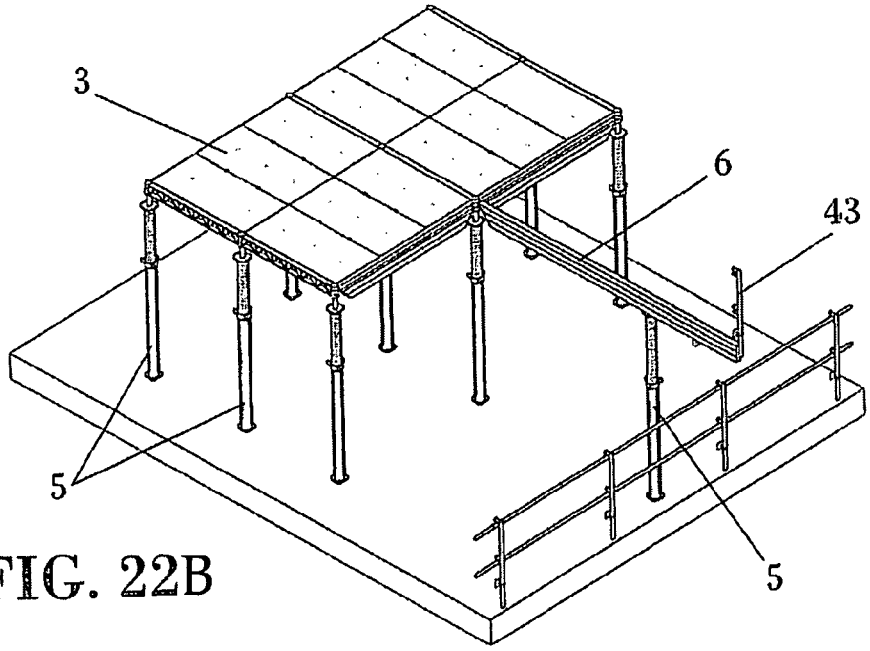
Figure 22C:
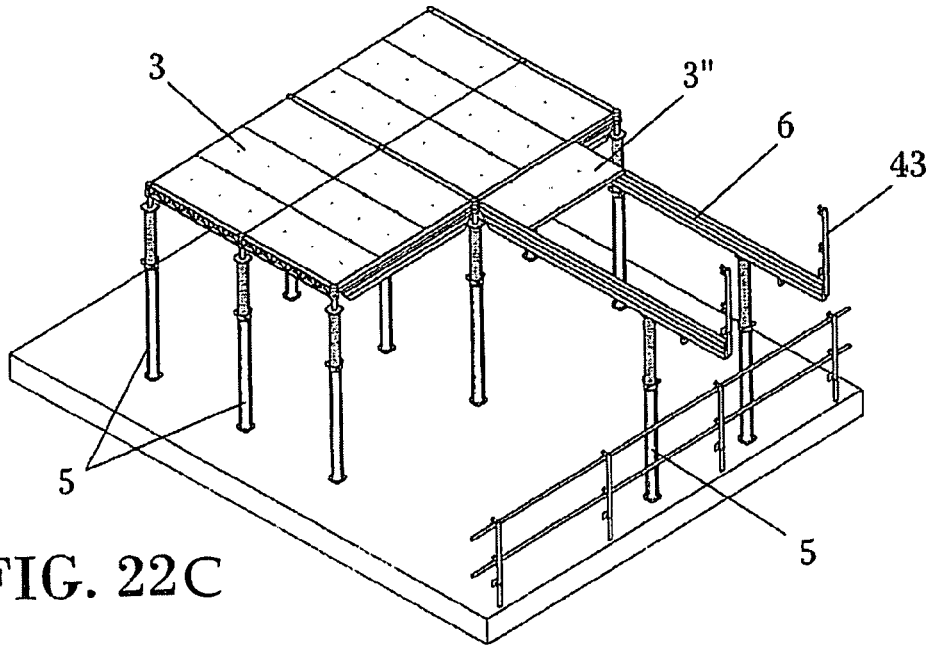
Figure 22D:
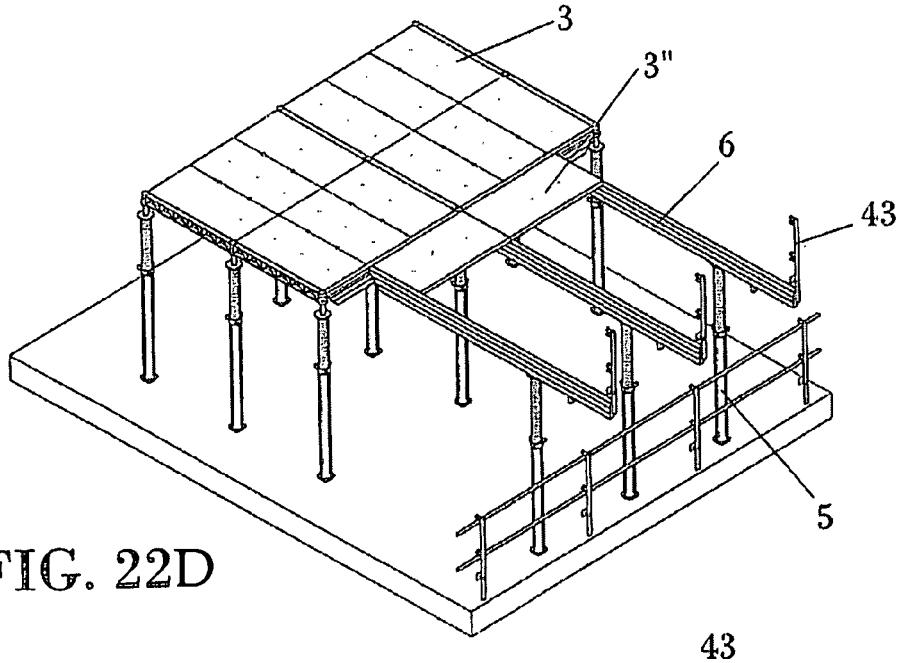
Figure 22E:
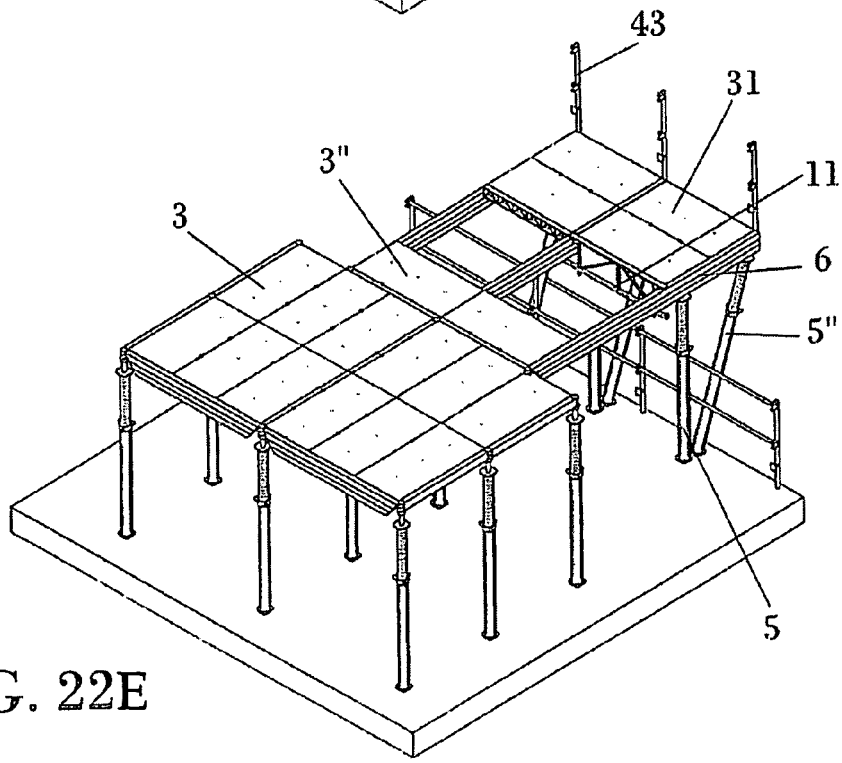
Figure 22F:
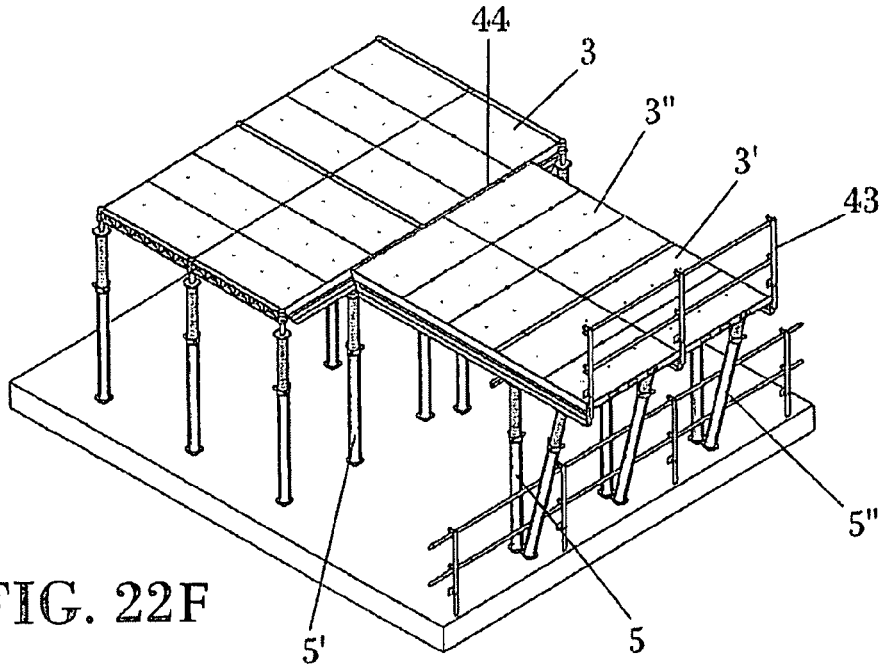

The underside assembly takes place according to FIGS. 22A to 22F according to the following steps:

First the railing shoe 10 is placed on the first perimetral beam 6, the first perimetral beam 6 is coupled perpendicular to the primary beam 2, which can be adjusted on the bolster 4 to which it is secured by the fixing element 19 or on the primary beam 2 with the collaboration of the joining clamp 20, then a prop 5 is placed which is moved to the end of the slab according to FIG. 22B. If it is not possible to place the joining clamp 20 due to the existence of a miter cut then the mooring 30 depicted in FIG. 10 is placed and the first perimetral beam 6 is moored to the slab by cables or straps. Then the next first perimetral beam 6 is placed, placing an inner formwork panel 3" before installing the joining clamp 20, since the inner formwork panel 3" defines the exact distance between first perimetral beams 6, the next joining clamp 20 is assembled and the system is leveled. Then the inclined prop 5' and the outer formwork panels 3' are placed, the straining piece 11 is installed as seen in FIG. 22E, the rest of inner formwork panels 3" are assembled and a prop 5 is assembled in the joining clamp 20 or in the mooring 30, and finally filler beams 44 covering the surface without formwork resulting from the 90° between beams are fitted.

Figure 23A:
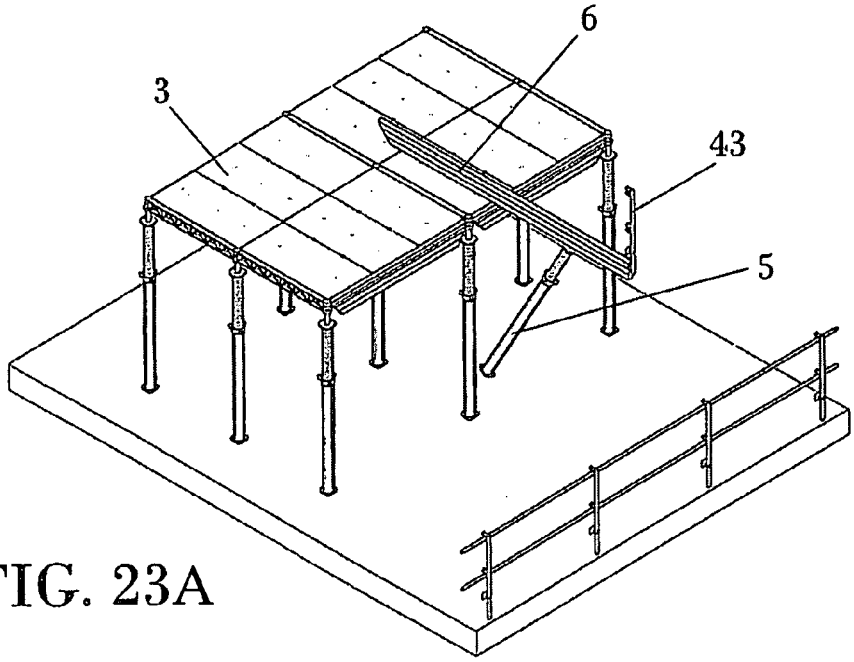
FIG. 23A-F are views showing the top side assembly sequence of the perimetral formwork solution with the straining piece for the case of the first perimetral beam perpendicular to the primary beam.
Figure 23B:
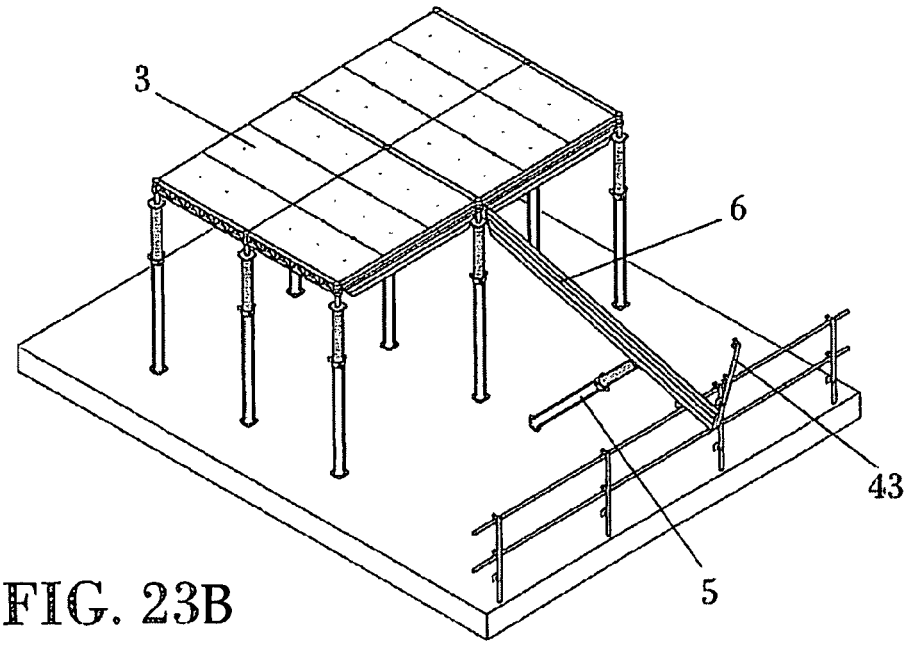
Figure 23C:
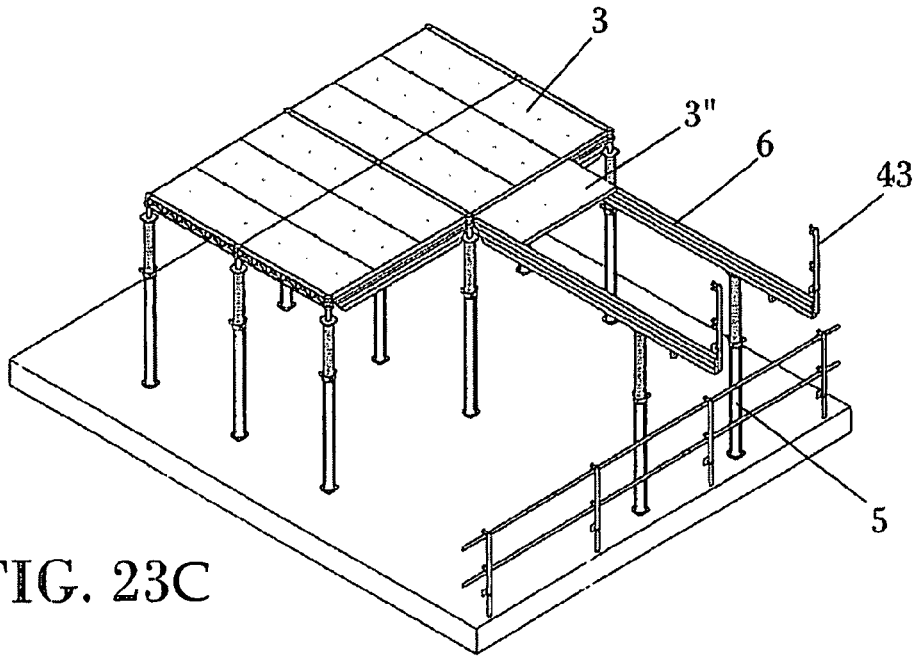
Figure 23D:
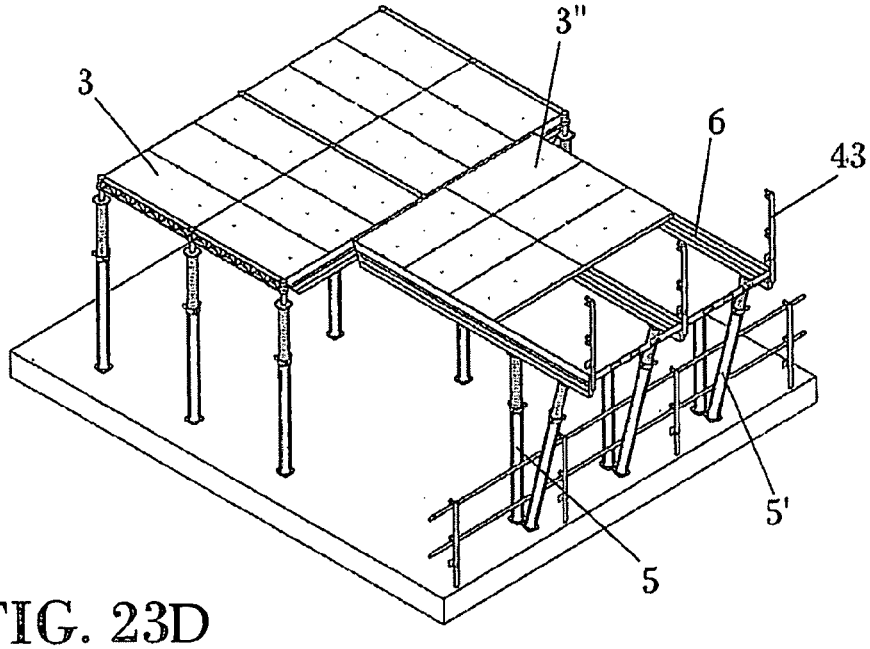
Figure 23E:
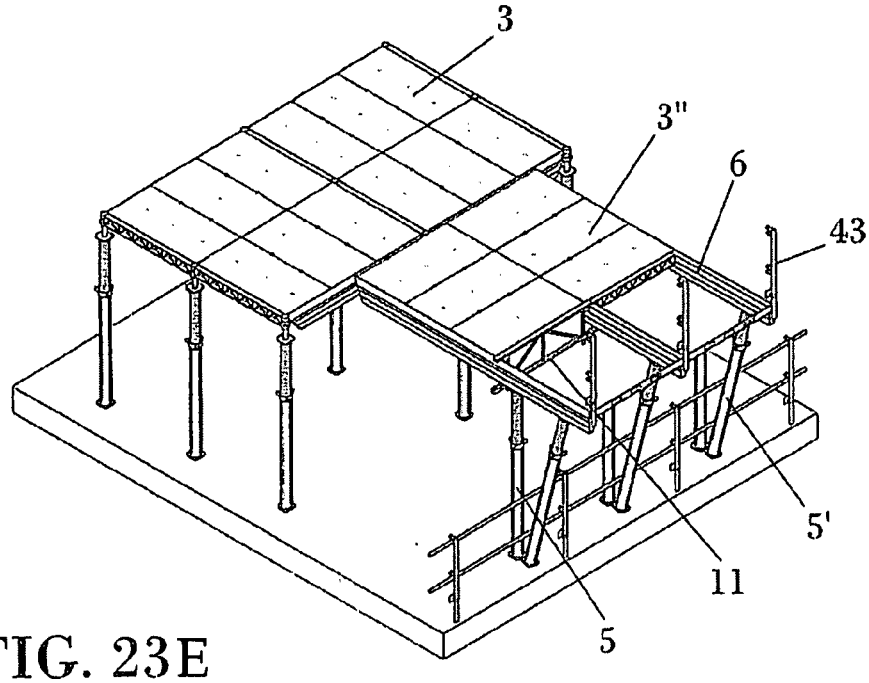
Figure 23F:
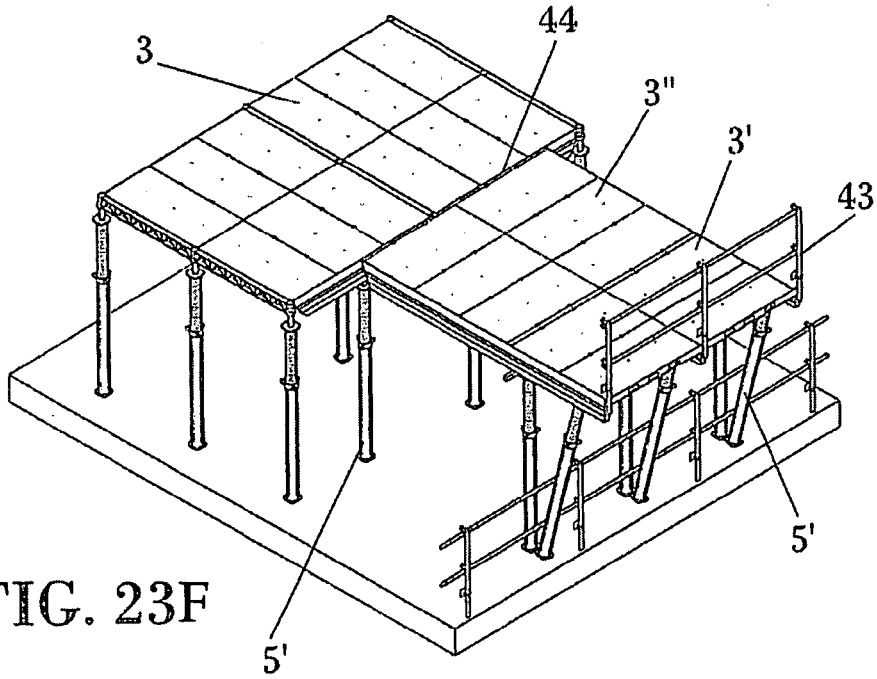

The top side assembly is carried out according to the following sequence depicted in FIGS. 23A to 23F:

The railing shoe 10 is placed on the first perimetral beam 6, the first perimetral beam 6 is slid on the base formwork 1 until a prop 5 can be introduced under it, it is moved towards the overhang until engaging the first perimetral beam 6 in the bolster 4 securing it with a pin 19 or on the primary beams 2 with the participation of a joining clamp 20, the next first perimetral beam 6 is placed without assembling the joining clamp 20 until placing an inner formwork panel 3", as seen in FIG. 23C, because the latter defines the exact distance between first perimetral beams 6, then placing the remaining inner panels 3", the joining clamp 20 is fitted and the system is leveled. Then the straining piece 11 and the remaining outer panels 3' are placed, the prop 5 of the joining clamp 20 or of the mooring 30 is placed and finally the filling beams 44 and baseboards are arranged.

Figure 21A:
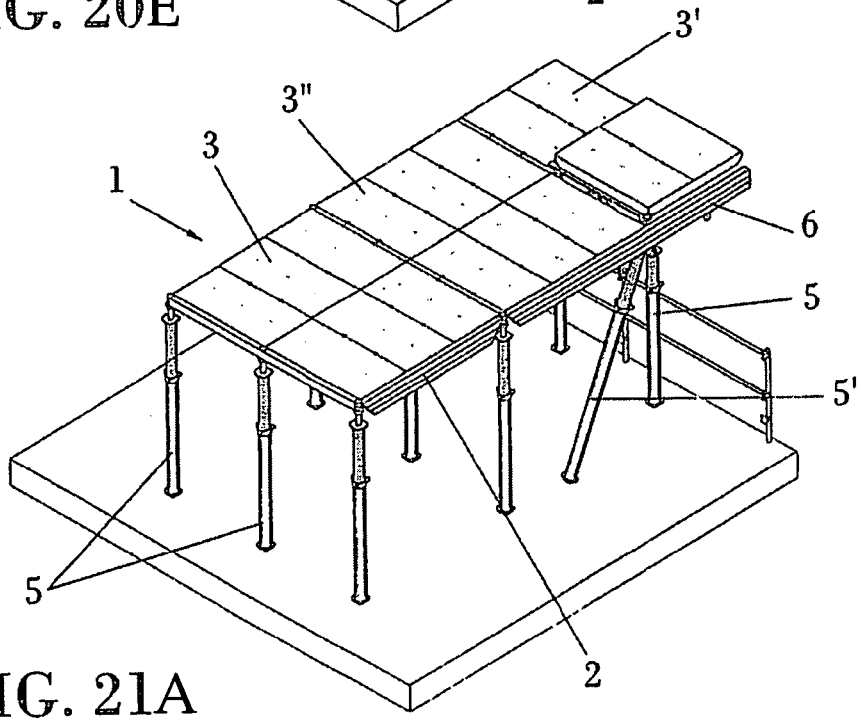
FIGS. 21A-F are views showing the formwork stripping sequence corresponding to the perimetral formwork solution with the straining piece.
Figure 21B:
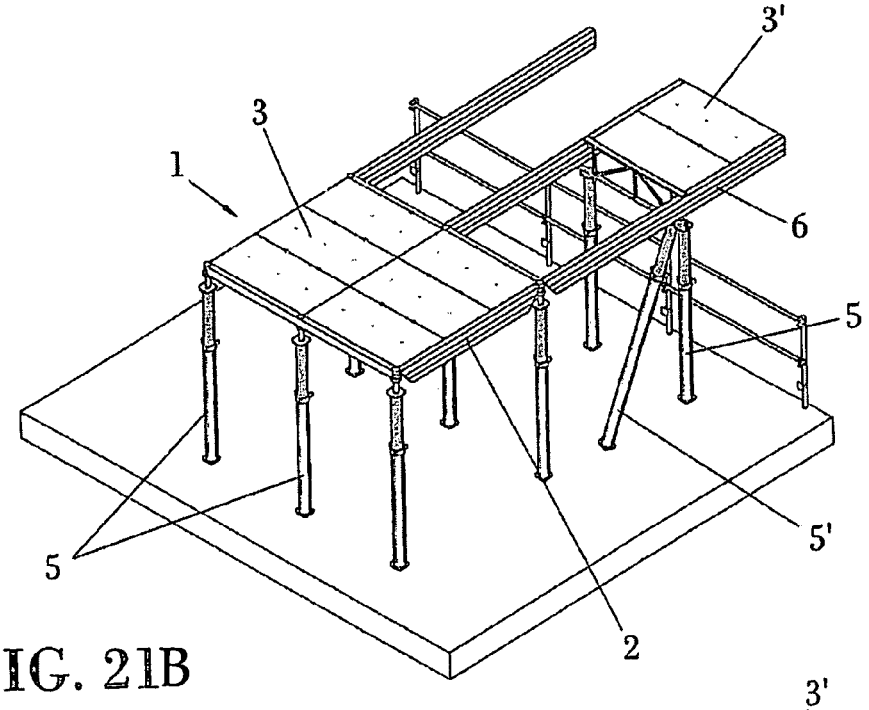
Figure 21C:
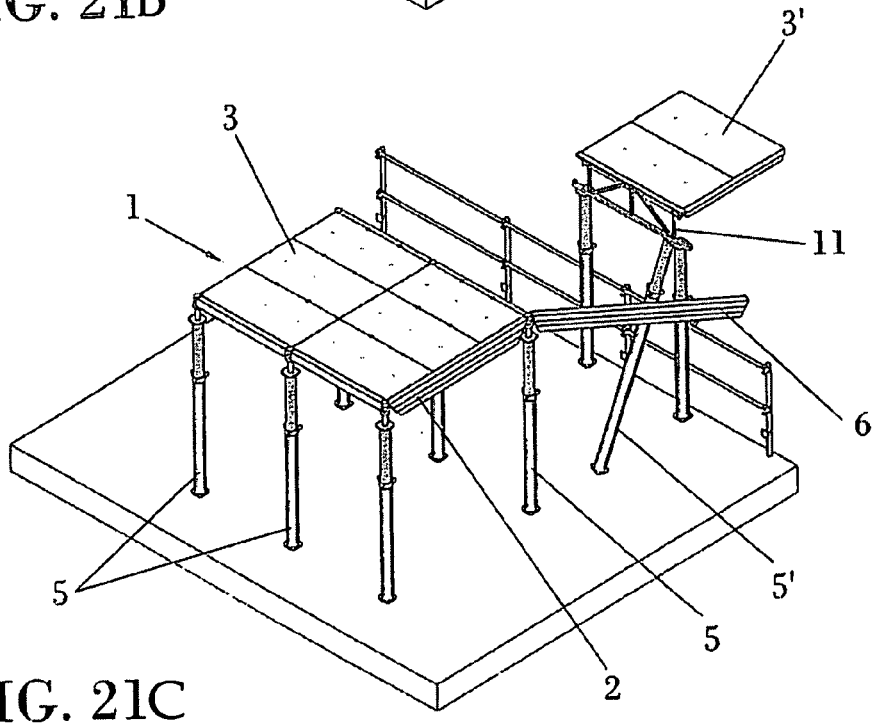
Figure 21D:
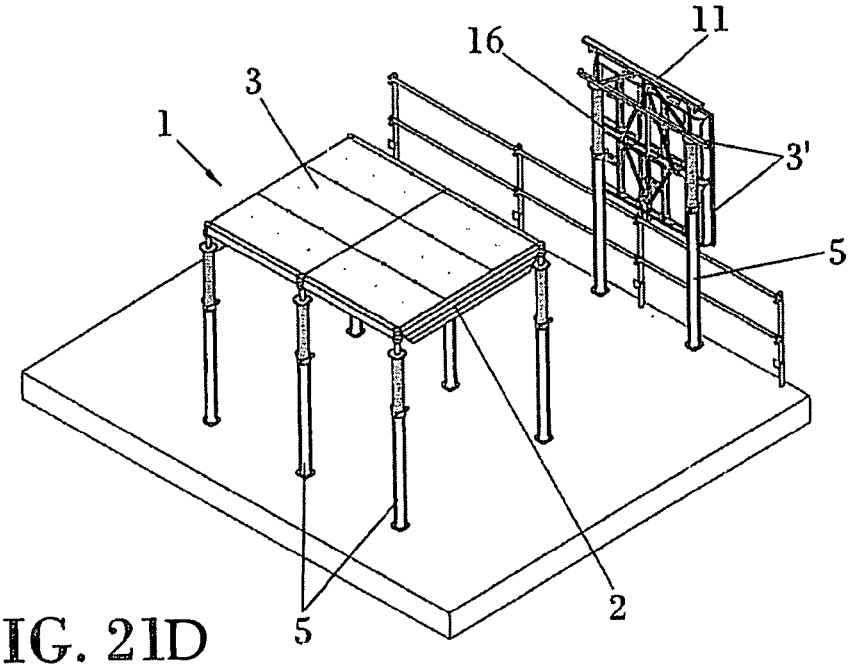
Figure 21E:
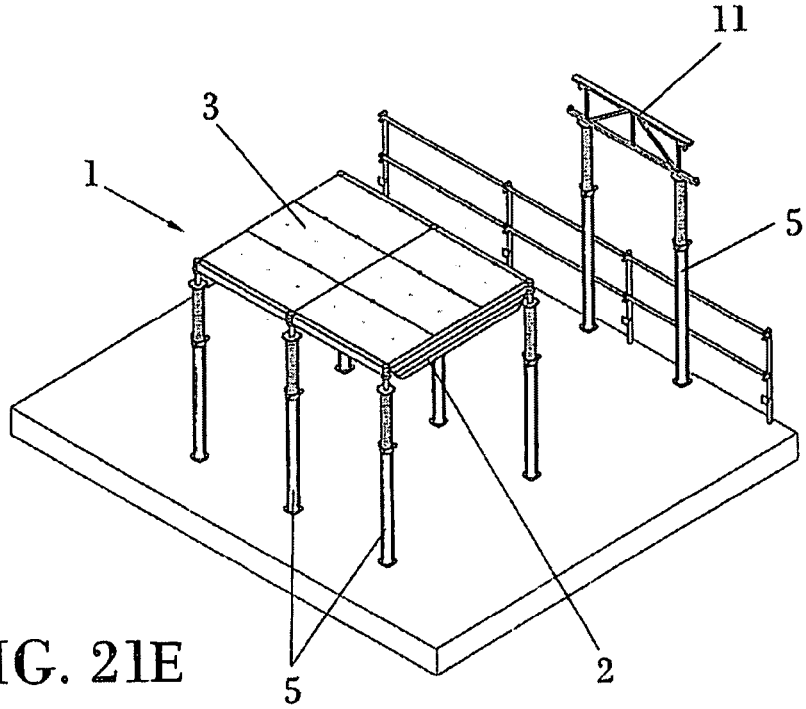
Figure 21F:
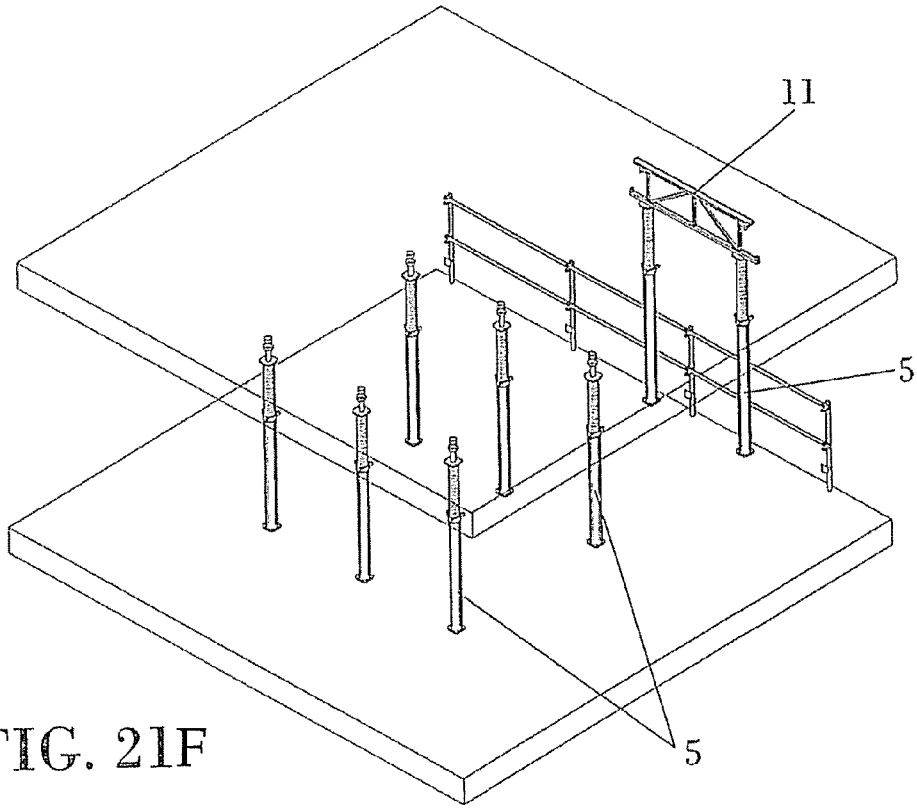

The assembly operations for the perimetral formwork have been seen up to this point; the formwork stripping operation will be described below, as seen in FIGS. 21A to 21F:

The railings 43, baseboards and railing shoes 10 are removed, the inclined prop 5' is removed, a prop 5 shoring up the straining piece 11 is placed, the formwork stripping tool 16 is placed in the straining piece 11 and props 5 shoring up said formwork stripping tool 16 are placed, and the support bolsters are lowered. The prop 5 supporting the first perimetral beam 6 is removed such that the latter is supported on the bolster 4 and on the straining piece 11, the inner panels 3" are removed according to FIG. 21B, then the outer panels 3' are shored up by the formwork stripping tool 16, as seen in FIG. 21C, the fastening bolt 19 or the joining clamp 20 are removed and the first perimetral beam 6 is removed. Then the formwork stripping tool 16 is removed by rotating it to the vertical position as can be seen in FIG. 21D, the outer panels 3' supported by said formwork stripping tool 16 are removed and the latter is disassembled. FIG. 21F is the formed slab and the formwork bearing elements.

Figure 24A:
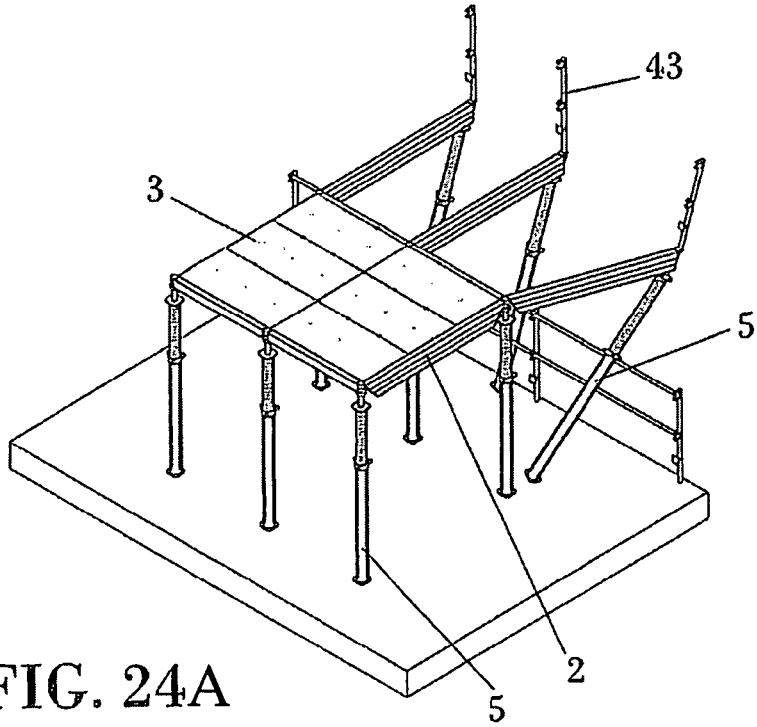
FIGS. 24A-C are views showing a top side assembly sequence of the perimetral formwork solution for the perimetral clamp solution.
Figure 24B:
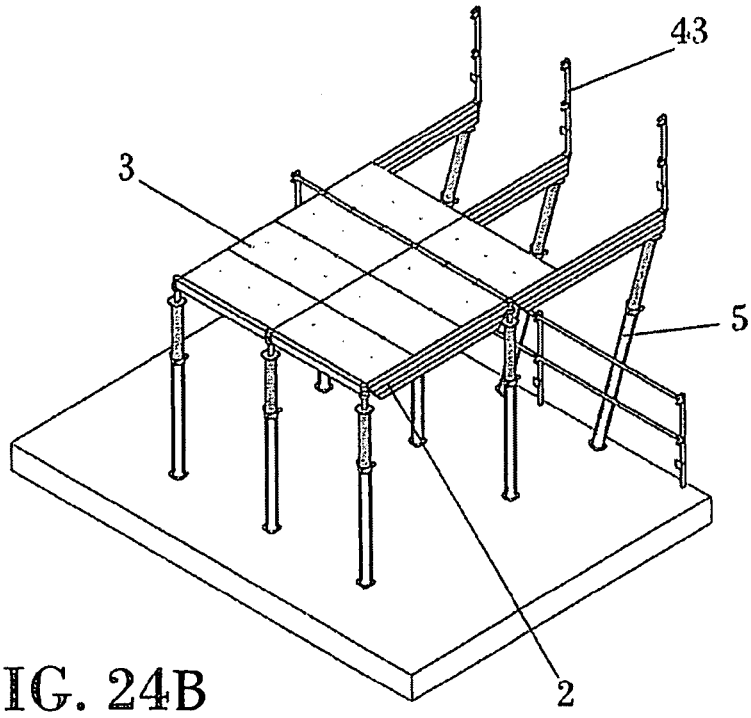
Figure 24C:
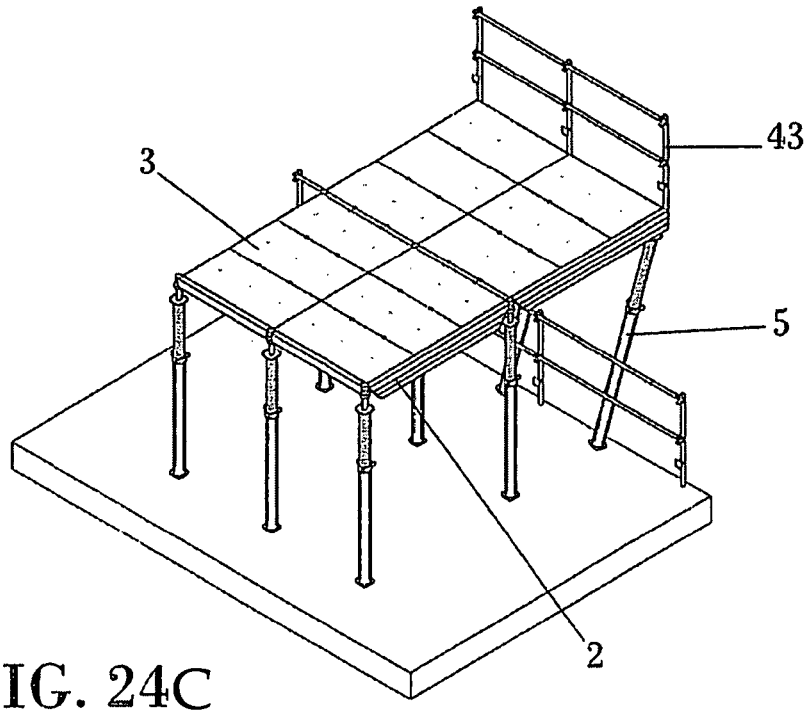

In the case of the second preferred embodiment contemplating the perimetral solution with a perimetral clamp 34, the assembly does not require the participation of a straining piece 11 and it occurs according to the following steps depicted in FIGS. 24A to 24C:

The second perimetral beam 2' is fitted through one of its ends to the perimetral clamp 34, the railing shoe 10 is placed on the perimetral clamp 34, an inclined prop 5' is then placed to lift the second perimetral beam 2', the fastening bolt 19 or the joining clamp 20 is fitted in the other end and then an inner panel 3" is placed until leveling the system, and finally the remaining panels 3', 3", railings 43 and baseboards are arranged.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware components configured to perform the specified functions. The particular implementations shown and described herein are illustrative examples of the invention and are not intended to otherwise limit the scope of the invention in any way. For the sake of brevity, conventional aspects of the systems (and components of the individual operating components of the systems may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". The word mechanism is intended to be used generally and broadly. Numerous modifications and adaptations will be readily apparent to those skilled in this art without departing from the spirit and scope of the present invention.

The invention claimed is:

1. A perimetral formwork system, applicable for configuring a overhanging working surface in an area adjacent a base formwork configured by a series of primary beams between which formwork panels are housed, the primary beams being coupled in support bolsters integral with vertical props supporting the base formwork, the formwork system comprising:

first perimetral beams incorporated within the formwork system, the first perimetral beams extending from the base formwork either in a direction that is parallel to the primary beams or in a direction that is perpendicular to the primary beams;

perimetral formwork panels;

the first perimetral beams having side supports for supporting the perimetral formwork panels;

the first perimetral beams being provided on a lower part with:

a moving connector for coupling a prop which can be moved to a chosen position;

an inclined connector for coupling an inclined prop; and an end housing for coupling a railing shoe;

the formwork system further comprising:

a fixing mechanism for fixing one of the first perimetral beams to the base formwork;

a straining piece which is disposed vertically between outer and inner ones of the perimetral formwork panels, the straining piece comprising a structure formed by an upper profile beam and a lower profile beam connected by intermediate profile beams, the upper profile beam being of which is provided with upper end supports fitting between the perimetral beams, the lower profile beam being provided with lower connectors extending from the lower profile beam for connection to props, the lower profile beam having ends which are provided with stops forming a support area for the first perimetral beams, the straining piece comprising one of the intermediate profile beams provided with a linkage hole; and a formwork stripping tool having support tongues which the outer perimetral formwork panels fit in and a linkage coupling in the linkage hole of the straining piece with such that the formwork stripping tool aides in lowering the outer perimetral formwork panels.

2. The perimetral formwork system according to claim 1, wherein the perimetral beams are assembled in the direction that is parallel to the primary beam, and the fixing mechanism comprises a fixing element preventing overturning of one of the perimetral beams.

3. The perimetral formwork system according to claim 1, wherein the fixing mechanism includes a fixing element that is bent twice in a same vertical plane and bent once in a lower horizontal plane, establishing an upper elongated section introduced in a hole in one of the perimetral beams, a vertical middle section and a lower section introduced between the support bolster and the one of the perimetral beams.

4. The perimetral formwork system according to claim 1, wherein the first perimetral beams are assembled in the direction that is perpendicular with regard to the primary beams, and the fixing mechanism comprises a joining clamp formed by a base reinforcement on which a plate is located provided with a first end fold which, together with a dentation of a moving part, form a guide which one of the primary beams fits in, and it is also provided with two opposing side folds forming a guide which one of the first perimetral beams fit in perpendicular to the primary beams.

5. The perimetral formwork system according to claim 4, wherein the moving part comprises a U-shaped part movable on the plate, flaps of which are provided with corresponding opposing perforations traversed by a wedge fixing the moving part against one of the primary beams, forming the fixing thereon, and a joining clamp is provided at a base of the plate with a connector to aid in coupling a prop.

6. The perimetral formwork system according to claim 4, wherein the plate has a second end fold, opposite to the first end fold, forming a striking area to aid in disassembling the joining clamp.

7. The perimetral formwork system according to claim 1, wherein the stops located at ends of the lower profile beam of the straining piece are constructed and positioned to limit mobility of the perimetral beams when the outer perimetral formwork panels move downwards in a formwork stripping operation.

* * * * *